US008368294B2

(12) United States Patent
Mii

(10) Patent No.: US 8,368,294 B2
(45) Date of Patent: Feb. 5, 2013

(54) BRIGHTNESS IMPROVING STRUCTURE OF LIGHT-EMITTING MODULE WITH AN OPTICAL FILM SURFACE LAYER

(76) Inventor: Jenn-Wei Mii, Taipei (TW)

( * ) Notice: Subject to any disclaimer, the term of this patent is extended or adjusted under 35 U.S.C. 154(b) by 455 days.

(21) Appl. No.: 12/745,519

(22) PCT Filed: Nov. 30, 2007

(86) PCT No.: PCT/CN2007/003411

§ 371 (c)(1),
(2), (4) Date: May 28, 2010

(87) PCT Pub. No.: WO2009/070925

PCT Pub. Date: Jun. 11, 2009

(65) Prior Publication Data

US 2010/0308709 A1 Dec. 9, 2010

(51) Int. Cl.
*H01J 61/42* (2006.01)

(52) U.S. Cl. ..... 313/318.11; 313/512; 313/485

(58) Field of Classification Search ..... 313/485, 313/512, 634, 635, 318.11
See application file for complete search history.

(56) References Cited

U.S. PATENT DOCUMENTS

| | | | | |
|---|---|---|---|---|
| 7,663,315 | B1 * | 2/2010 | Hulse | 313/512 |
| 2009/0225529 | A1 * | 9/2009 | Falicoff et al. | 362/84 |
| 2011/0095686 | A1 * | 4/2011 | Falicoff et al. | 315/35 |

* cited by examiner

*Primary Examiner* — Nimeshkumar Patel
*Assistant Examiner* — Christopher Raabe
(74) *Attorney, Agent, or Firm* — patenttm.us

(57) ABSTRACT

A brightness improving structure of a light-emitting module with an optical film surface layer 12, wherein a light-emitting part 20 is provided inside a transparent envelop 10 and may emit ultraviolet or blue light, the said transparent envelop 10 has first wall and second wall, first inside wall 101 and second inside wall 103 are oppositely formed inside thereof, first outside wall 102 and second outside wall 104 are oppositely formed outside thereof. The first wall is partly or entirely provided with the optical film coating 12, the optical film coating 12 may at least reflect the ultraviolet or blue light exciting fluorescent/phosphorescent light, and may pass light rays comprising visible light. A visible light layer or both the visible light layer and a reflective layer are provided on the second wall, and the said light-emitting part 20 is placed at a setting location from the envelop 10.

22 Claims, 23 Drawing Sheets

BRIGHTNESS IMPROVING STRUCTURE OF LIGHT-EMITTING MODULE WITH AN OPTICAL FILM SURFACE LAYER

BACKGROUND OF THE INVENTION

1. Field of the Invention

The present invention relates to a brightness improving structure for a light-emitting module with an optical thin-film surface layer, which can notably improve the brightness of the light-emitting module at high reflectance and transmittance by spacing a light-emitting part of the light-emitting module and a reflective layer of a transparent envelop of the light-emitting module at a certain interval in a concentric circle relationship.

2. Description of the Prior Arts

There are many kinds of light-emitting modules known in the art, such as a daylight lamp, a fluorescent tube or the like. The fluorescent tube is mainly provided with a transparent envelop having an inside wall fully coated with a fluorescent layer. The inside of the envelop is filled with electrically excited lighting gases such as mercury and argon gas, or xenon and neon etc. mercury-free gas. When powered by a high voltage the gases inside of the envelop are excited and emit ultraviolet light. The ultraviolet light then hits the fluorescent layer and is excited into visible light. The visible light then emits outwardly through the fluorescent layer and the transparent envelop. However, in operation, since the inner wall of the fluorescent layer of this kind of light-emitting module is firstly excited into the brightest region by the ultraviolet light, it is necessary for the visible light to travel through the thickness of the fluorescent layer itself for further use. The fluorescent layer can more or less convert ultraviolet light into visible light, but it is a poor material for visible light to transmit therethrough. As a result, luminous efficiency is very low. In general, the coated fluorescent layer is made as thin as possible to improve the light transmittance, but this causes the ultraviolet light to be insufficiently absorbed. The person skilled in the art usually needs to compromise between the high transparency of the fluorescent layer and the sufficient absorption of the ultraviolet light and find an optimum point. The transparency of organic fluorophor is generally higher than that of inorganic fluorophor, but the duration of the former is shorter than that of the later. Thus the inorganic fluorophor is generally used for luminous application. Accordingly, the aforementioned low luminous efficiency defect has not been solved till now.

Further, even if the product is under an optimal operation condition the brightness of the visible light at the fluorescent inner layer will attenuate more than a half when passing through the wall thereof to the outer layer (as shown in FIG. 24). The effect of the fluorescent layer on the visible light transmittance will be simply clarified by the following experiment: place an unlighted fluorescent tube before a lighted one and then compare the brightness before shielding by the unlighted fluorescent tube and that after shielding by the unlighted fluorescent tube, you will find that the brightness after shielding is considerably lowered.

SUMMARY OF THE INVENTION

In view of the deficiencies of low brightness and low luminous efficiency of the prior art light-emitting module; the present invention provides a brightness improving structure for the purpose of improving the whole brightness of the light-emitting module and saving power consumption.

In order to achieve the above-described object, a brightness improving structure of a light-emitting module with an optical thin-film surface layer is provided. The structure comprises:

a transparent envelop shaped as a hollow sphere and having a first wall and a second wall opposite to the first wall, said first wall having a first inside wall surface and a first outside wall surface, said second wall adjoining said first wall and having a second inside wall surface and a second outside wall surface;

an optical thin-film which being a non-omni angular multiple layers film and having a long wave pass light filter function, and being coated on the first wall surface of the transparent envelop over 30% of its area, said optical thin-film reflecting light rays at least comprising ultraviolet or blue light exciting a fluorescent/phosphorescent layer and at least comprising visible light source which being in the long-wave band of visible wave length, and running through to emit;

a light-emitting part shaped as a spherical area arranged in the transparent envelop for emitting ultraviolet or blue light; and a visible light layer formed of the fluorescent/phosphorescent layer, said visible light layer being coated on the second wall surface of the transparent envelop for exciting the ultraviolet or blue light into visible light.

The distance c between an any point A of the reflecting layer of said optical thin-film and a center of sphere B of the light-emitting part should meet the following relationship: $c \geqq \csc\alpha \times r$, wherein r being the radius of the light-emitting part, a being the incidence angle at the point A of the reflecting layer of said optical thin-film, a connection line of A and B being the normal of the reflection angle at point A, and b being the distance projecting to tangential point of the periphery circumference of the light-emitting part from the point A of the reflecting layer.

According to one aspect of the brightness improving structure of the light-emitting module with the optical thin-film surface layer of the present invention, the light-emitting part being an ultraviolet or blue light luminescent tube arranged in the light-emitting part in form of rotation-wound, the inside wall surface of said luminescent tube being partially coated with a fluorescent/phosphorescent layer. The inside lower wall surface of said luminescent tube forms a straight wall surface coated with the fluorescent/phosphorescent layer. The light-emitting part is at least an LED arranged in the light-emitting region for emitting ultraviolet or blue light or at least an LED projecting light into the light-emitting region for emitting ultraviolet or blue light. The transparent envelop being a partial sphere, which having an arc spherical surface and a bottom thereof interconnecting with each other, said first wall is arranged on the arc spherical surface of the partial sphere and said second wall is arranged on the bottom of the envelop. At least a part of the light-emitting part is a partial sphere whose arc spherical surface is opposite to the arc spherical surface of the transparent envelop while the second wall of the transparent envelop extends into the light-emitting part.

According to another aspect of the brightness improving structure of the light-emitting module with the optical thin-film surface layer of the present invention, the structure is further provided with a reflective lampshade shaped as a hemisphere with a radius, at least one hemisphere transparent envelop or one sphere transparent envelop composing two hemisphere transparent envelops being provided therein, said radius being larger than or equal to the diameter of the transparent envelop, and the extension line of the bottom of the hemisphere-shaped transparent envelop being positioned at the center of sphere of the reflective lampshade and an any point on the lampshade wall. The transparent envelop and the reflective lampshade may be concentrically arranged at intervals in a relationship as described by $c \geqq \csc\alpha \times r$ to enable the reflective layer of the reflective lampshade to use the full-dielectric invisible light reflection film. At present, the product with reflectance of ≧99.5% at 0 to 45° and 400 nm to 800 nm is available. The extension line is preferably at the center of the reflective lampshade.

According to yet another aspect of the brightness improving structure of the light-emitting module with the optical thin-film surface layer of the present invention, the incidence angle α is 0 to 60°, preferably 0 to 15°. The second wall of the transparent envelop is coated with a reflective layer at the outside of the visible light layer.

Through the above techniques to improve the brightness, the present invention can reflect part of or all of the ultraviolet or blue light source to the visible light layer through the design of a certain distance between the light-emitting part and the long wave pass filter of the optical thin film non-omni directional angle of incidence coated on the inside wall of the transparent envelope, while the visible light can excite a visible light source after absorbing the ultraviolet or blue light, which can transmit through the optical thin film, therefore, its brightness can be improved due to the formation of the brighter fluorescent surface layer under certain energy, and if the light-emitting module within the light-emitting part is a tube or a UVLED emitting ultraviolet, the optical thin film of the first wall of the transparent envelope is coated on the whole wall, if the module within the light-emitting part is a blue light-emitting tube or blue light LED, the optical thin film is a partial coating, so that those parts with no coating are transparent to blue light and visible light, and the coated parts are transparent to red light and green light excited by the blue light, therefore, appropriate red, green and blue can be produced through adjusting the ratio of the coated parts and the uncoated parts to achieve the output of white light.

Therefore, the fluorescent layer of the present invention can be thickened as possible without fear of blocking the pass of visible light, so the ultraviolet light is fully absorbed and the brightness is higher than the inner layer of the tube of the prior art. In the brightness improving structure of a light-emitting module with an optical thin-film surface layer, the thickness of the fluorescence/phosphorescent layer in the visible light layer is 60 μm to 1000 μm, and the aim of thickening is to fully and completely absorbing the ultraviolet light, of course, an ultraviolet light of a fixed intensity will be fitted with a most appropriate thickness, however, taking a low-voltage mercury lamp as an example, when a single-sided surface layer light-emitting coating is thickened, its brightness will be significantly increase, this is different from a low-voltage mercury lamp less than 30 μm thick in the past, and this also proves that the existing mercury lamps with all sides coating give up the absorption of the ultraviolet light for the transparency of the fluorescent coating, which is indeed a great loss of energy.

In addition, in case that no too thick fluorescent coating is needed, the fluorescent coating can be formed on the straight surface and a larger reflective surface may be additionally provided at its vertical point, so that not only the surface layer fluorescence but also the inner layer fluorescence can be taken out at the same time, making the brightness and efficiency improved with energy saving.

DESCRIPTION OF THE REFERENCE NUMBERS

Figure 1:
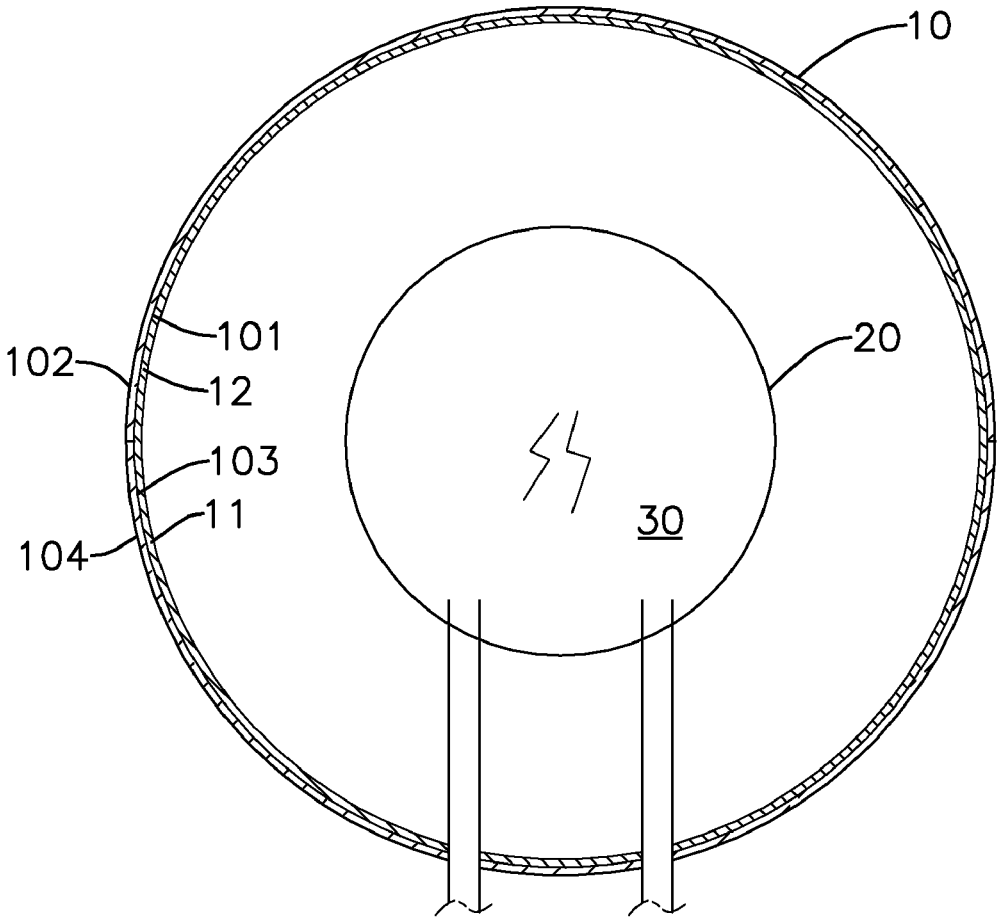
FIG. 1 is a schematic diagram of the present invention.

10, 10', 10*a*, 10*b* and 10*c*—transparent envelope; 10*d*, 10*e*, 10*f*, 10*g* and 10*h*—transparent envelope; 100—cone; 100*a*—supporting body; 101—first inside wall; 102—first outside wall; 103—second inside wall; 104—second outside wall; 11, 11', 11*a*, 11*b* and 11*c*—visible light layer; 11*d*, 11*e*, 11*f*, 11*g* and 11*h*—visible light layer; 12, 12', 12*a*, 12*b* and 12*c*—optical thin film; 12*d*, 12*e*, 12*f*, 12*g* and 12*h*—optical thin film; 13—electric connector; 20, 20', 20*b* and 20*c*—light-emitting part; 20*d*, 20*e*, 20*f*, 20*g* and 20*h*—light-emitting part; 21, 21*b*, 21*e*, 21*f*, 21*g* and 21*h*—light-emitting tube; 30—light-emitting body; 40—lamp; 41—outer envelope; 411—electric connector; 42—reflective layer; 50—lamp; 50*a*—lamp set; 51—holder; 52—reflective layer; 53—reflective piece; 54—light-emitting tube; 60—lamp; 61—transparent envelope; 62—light-emitting part; 621—light-emitting tube; 622—reflective piece; 70—transparent envelope; 71—optical thin film; 72—light-emitting part; 731—visible light layer; 80, 80*a*, 80*b*, 80*c* and 80*d*—lampshade; 801—reflective lampshade; 802—reflective layer; 81, 81*a*, 81*b*, 81*c*, 81*d*, 81*e* and 81*f*—transparent envelope; 82, 82*a*, 82*b*, 82*c*, 82*d*, 82*e* and 82*f*—light-emitting part; 821, 821*a*, 821*b* and 821*c*—light-emitting tube; 821*d*, 821*e* and 821*f*—UV light-emitting diode; 83, 83*a*, 83*b*, 83*c*, 83*d*, 83*e* and 83*f*—optical thin film; A—reflective layer; B—central point; C—distance.

DETAILED DESCRIPTION OF THE INVENTION

The above and other technical features and advantages of the present invention will be described in greater detail with reference to the drawings.

DEFINITIONS

Transparent envelope: can be composed of glass or ultraviolet-absorbing glass or other heat-resistant transparent materials, such as polycarbonate resin, etc. However, if the transparent envelope being a resin, plastic or glass that can pass through the ultraviolet light, when some long-wave pass light filter film layers only reflecting specific ultraviolet light exciting fluorescent layer due to the design, other long-wave ultraviolet lights may pass along with the visible light through the long-wave pass light filter film layers that may affect people or damage the resin itself, thereby an anti-ultraviolet film layer being required.

Optical thin film: which being a non-omni angular coating, represented by a long wave pass light filter of non-omni angular. Optical thin film light filter being composed of all dielectric coating which being very thin, and basically ¼, i.e. $\lambda/4$ of the wavelength of light, of course, there are various combinations, such as $\lambda/2$, $\lambda/10$, etc., but re-composed of different materials with high-low different refractive indexes, with different thickness for different sizes.

Visible layer: being composed of fluorescent/phosphorescent layer, which may be a material which being excited into white light by ultraviolet light or a material which being excited into red, green or yellow light by blue light.

Referring to FIG. 1, which shows a brightness improving structure of a light-emitting module with an optical thin-film fluorescent/phosphorescent surface layer of the present invention, wherein the light-emitting module comprising a transparent envelope 10, a light-emitting part 20 and a light-emitting body (30, etc.), and wherein transparent envelope 10 being a hollow circular sphere, a partial hollow of sphere, a hollow body similar to a sphere or a long type hollow circular tube body, of which the hollow circular sphere being a preferred embodiment, which is shown in a sectional view in the figure, the transparent envelope 10 having a first wall and a second wall opposite each other, with a first inside wall 101 and a second inside wall 103 opposite each other being formed within the first and second inside walls, and a first outside wall 102 and a second outside wall 104 opposite to the first outside wall formed on its external wall, and the surface of the first inside wall 101 or the first outside wall 102 adjoining inside and outside side walls of the envelope being coated with optical thin film 12, and the surface of the second inside wall 103 or the second outside wall 104 adjoining inside and outside side walls of the envelope being coated with a visible light layer 11, or is coated with a visible coating layer 11 and a reflective layer; if the optical thin film 12 or the visible layer coated on the outside wall being took ultraviolet light as an excitation light source, the transparent envelope 10 must be a material that is transparent to ultraviolet light while the material being not damaged.

Light-emitting part 20, which being a sphere or formed into a spherical area, and may be designed as a partial sphere, and its outer diameter being less than the inner diameter of the transparent envelope 10, and being arranged within the transparent envelope 10, so that the transparent envelope 10 and the light-emitting part 20 being space-arranged, so there is a space therebetween, wherein the space may be filled with nitrogen or an inert gas, with the light-emitting part 20 being designed according to the shape of the transparent envelope 10;

The light-emitting body 30 producing ultraviolet light source or short-wave light source and emitting in all directions, wherein the fluorescence/phosphorescent layer being excited by the ultraviolet or short wavelength light towards the visible light layer, and the visible light or long wave light emitting from the surface layer passing through to send out from the optical thin film 12, and the ultraviolet light source or short wave light source (see FIG. 23) emitting towards the coated optical thin film 12 will be reflected to the visible light layer 11 by the optical thin film 12, at this moment, the visible light layer 11 being at the surface layer light-emitting state of the fluorescence/phosphorescence, and having joined in more ultraviolet or short wavelength light the fluorescence/phosphorescence will be brighter, and the visible light source re-emits towards the optical thin film 12 to improve the brightness of the overall lighting;

Furthermore, the light-emitting part 20 can be provided with an light-emitting tube or sets of light-emitting electrodes for direct discharge, or provided with at least one ultraviolet or blue light-emitting diode to emit ultraviolet or blue light in all the directions in the formed sphere area or partial sphere, wherein light-emitting tube being provided within the light-emitting area in form of rotation-wound, with the surface of its inner wall being coated with fluorescence/phosphorescent layer.

Figure 23:
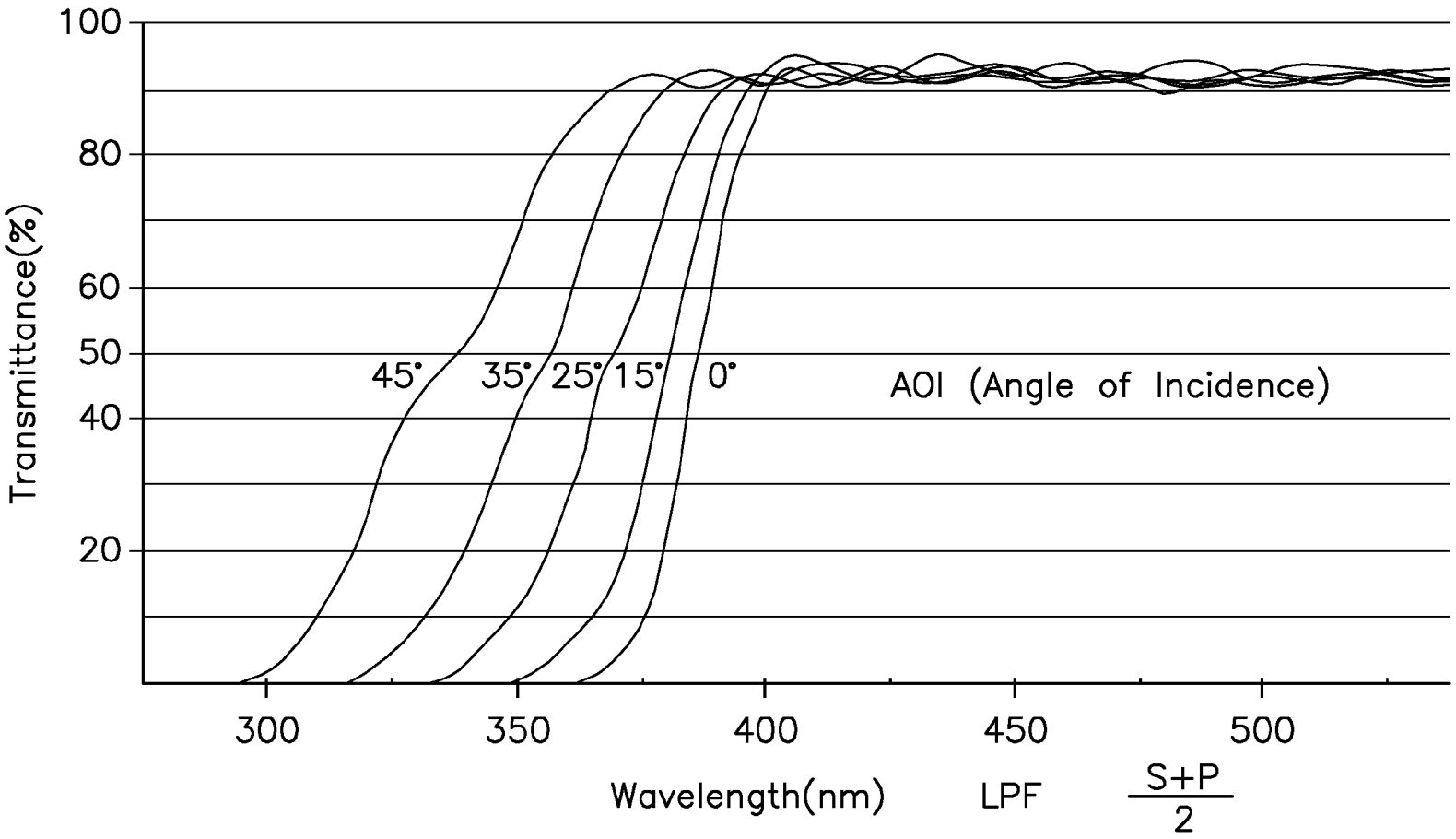
FIG. 23 is a schematic diagram of the spectrum of the long wave pass optical thin film in working.

Additionally, the angle of incidence (AOI) of the optical thin film 12 coated on the transparent envelope 10 being non-omni-regular coating, which being usually set at zero degree, and the reflection and penetration of its long wave pass light filter thin film layer is very good, but the magnitude of the angle of incidence used is not large, if the designed angle of incident being 0 degree, there shall be no great difference when ±15 degrees being used, and if ±45° being used, a comparatively large blue shift shall be formed, however, despite the formation of the blue shift, if the required bands of the reflected ultraviolet are in the reflection region, it is feasible in application. As shown in FIG. 23, if excited by blue light, the limit to the angle of incidence being even smaller, and the vertical edge filter is more suitable. Comparing to the omni regular coating over hundreds of layers, such a coating is low in price and easy in production, with no peeling in long-term use. In the further design of the present invention, the transparent envelope 10 and the light-emitting part 20 being in the shape of a concentric circle and set within a specific distance range to comply with their relatively small angle of incidence, therefore, a very high reflectivity (≧99.5%) and transmittance (≧95%, with the other side having an anti-reflection layer), to improve and enhance the brightness of the light emitted by the light-emitting module.

Figure 2:
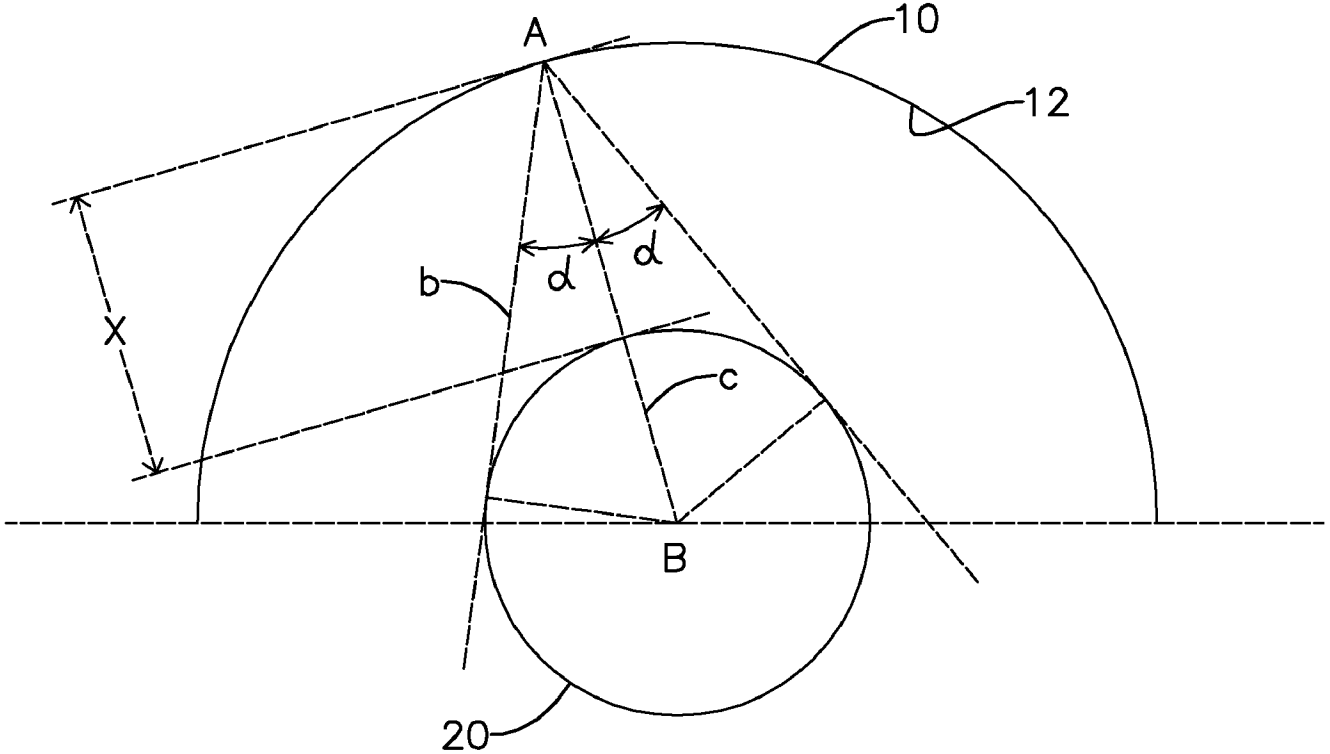
FIG. 2 is the relative positions of optical thin film and the light-emitting part of the present invention.

Referring to FIG. 2, the light-filtering reflective layer A of the optical thin film being contained at the outside of the light-emitting part 20 and spaced by a distance, wherein the distance from the reflective layer A to the central point B of the light-emitting part 20 being c, and b being the distance projecting to the tangential outside the circumference of the light-emitting part 20 from the reflective later A, and the radius of the light-emitting part 20 being r, therefore, if the angle of incidence of the reflective layer A of the optical thin film 12 being set to $\alpha$, the distance c from the central point B of the light-emitting part 20 to the reflective layer A should be greater than or equal to $\csc\alpha \times r$, i.e. $c \geqq \csc\alpha \times r$, so, based upon this, when the distance c can be calculated and the radius of the light emitting part 20 further being set, and setting the distance between the transparent envelope 10 provided with the reflective layer A and the central point B of the light-emitting part 20 when the light-emitting part 20 is set at a certain radius, can be calculated, namely, the distance x=c−r from the reflective layer A to the light-emitting part 20, for example, if the angle of incident α is 0 degree to 30 degrees, c=2r, and x=r, and it can be seen that part of the visible light source emitted by the visible light layer 11 being transmitted through the optical thin film 12, and the rest ultraviolet light source that cannot be transmitted being reflected to the visible light layer 11 and excited into visible light and re-emitted, to improve the whole brightness.

Figure 3:
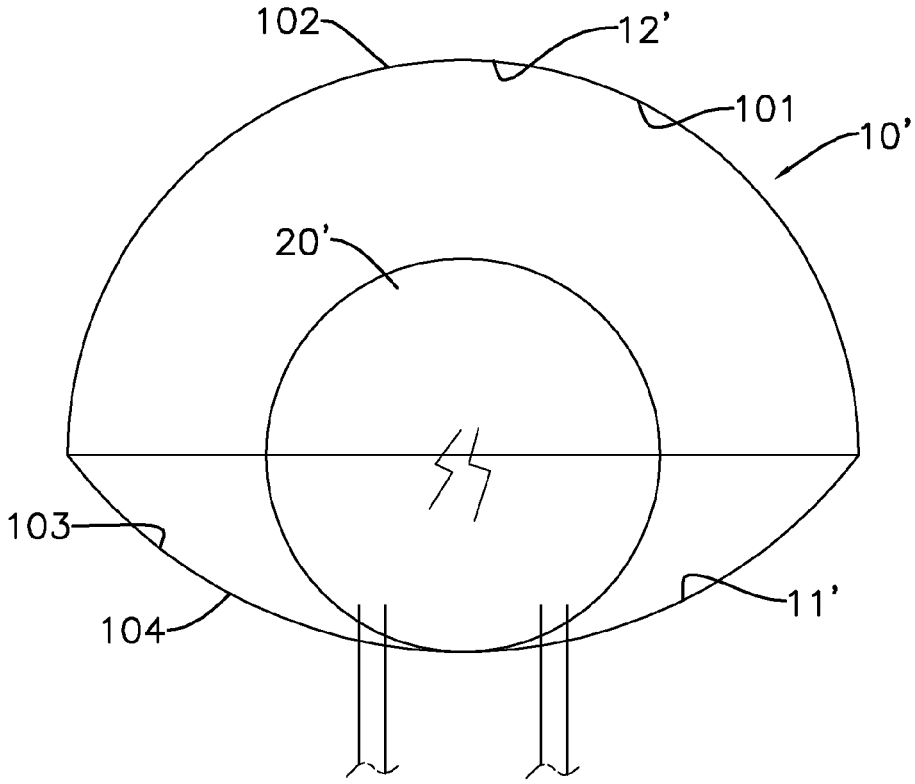
FIG. 3 is another schematic diagram of the present invention.

Referring to FIG. 3, which is the light-emitting module of another embodiment, of which the transparent envelope 10' is a hollow envelope composed of hemisphere body and half of an arc body, with a first inside wall 101 and a first outside wall 102 being formed within the inside or outside of the hemisphere respectively, and an optical thin film coating 12' can be chosen to be coated on the first inside wall 101 or the first outside wall 102, and the second inside wall 103 and second outside wall 104 being formed within the inside and outside walls of the half of an arc body respectively, and a visible light layer 11' or a visible light layer 11' and a light reflective layer being coated on the second inside wall 103 or the second outside wall 104, wherein the transparent envelope 10' is provided with a light-emitting part 20', the center of which being located at the center of the hemisphere of transparent envelope 10'.

Figure 4:
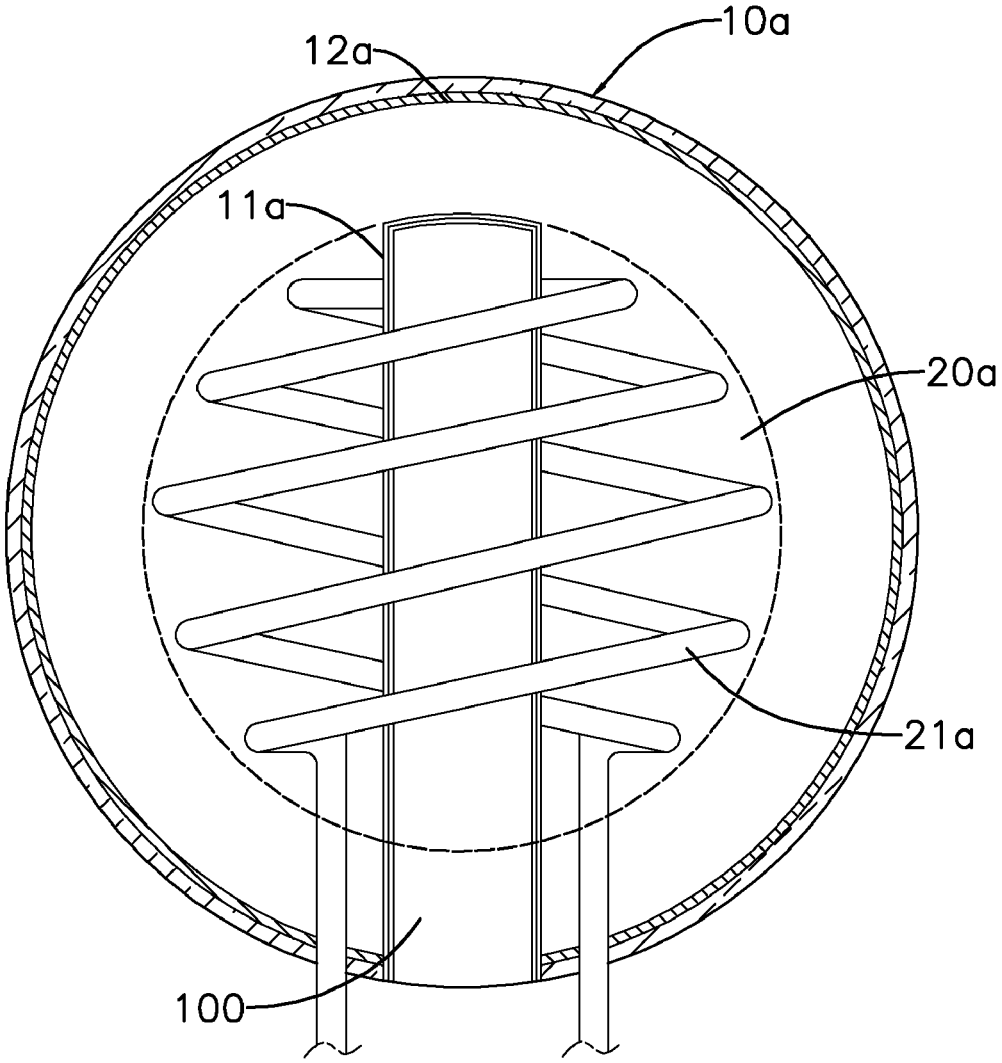
FIG. 4 and FIG. 5 are schematic diagrams of the present invention shaped as a sphere.
Figure 5:
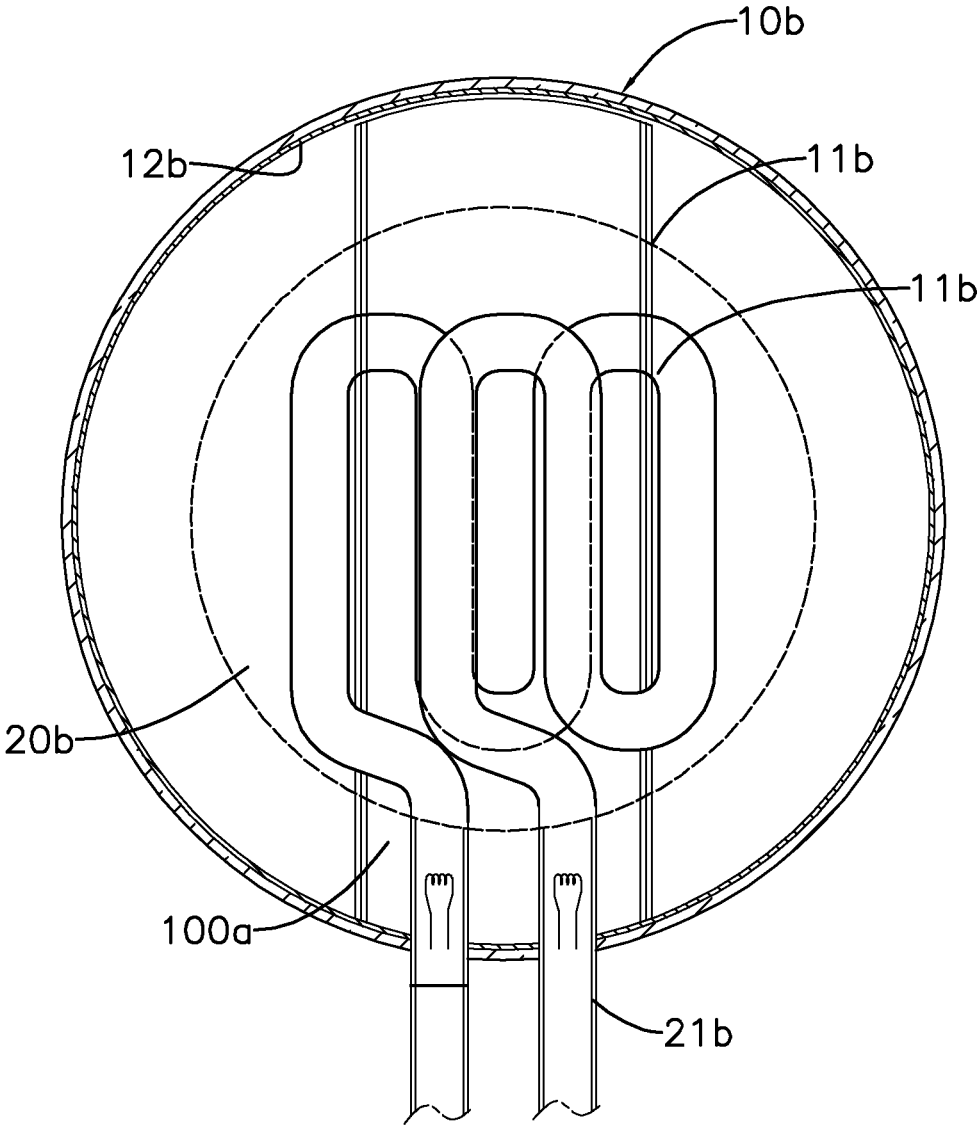

Referring to FIG. 4, the profile of the light-emitting module of this embodiment being a spherical shape, wherein the transparent envelope 10*a* is a hollow sphere, with an optical thin film 12*a* being coated on its inside wall (or its outside wall), and a second wall being formed at its internal center, which embodiment being an projecting extend hollow cylinder 100, with the outside wall or the inside wall of the cylinder 100 being coated with a visible light layer 11*a*, and a light-emitting part 20*a* being provided within the transparent envelope 10*a* and located outside of the cylinder 100, which concrete embodiment may being that a round spherical area similar to sphere being formed by a light-emitting tube 21*a* through bending around the outside of the cylinder 100;

Referring to the embodiment shown in FIG. 5, the light-emitting module being a spherical shape, wherein the transparent envelope 10*b* is a hollow sphere, with an optical thin film 12*b* being coated on its inside wall (or outside wall), and a second wall is formed within the transparent envelop 10*b*, with a light-emitting part 20*b* being provided at the second wall, and the concrete embodiment of the second wall being a hollow pillar body 100*a*, and the pillar body 100*a* may be of square or circular shape and provided circumferentially with a light-emitting tube 21*b*, which is a tube of semi-circular shape in cross section, with the outside wall of its plane side leaning against the wall surface of pillar body 100*a*, and the light-emitting tube 21*b* is coated with a visible light layer 11*b* or a visible light layer 11*b* and a light reflective layer on the inside wall of the flat side and the wall surface of the hollow pillar body, respectively;

With the light-emitting modules in these two embodiments, after emitting light source by the light-emitting parts 20*a*, 20*b*, the visible light penetrating the optical thin film 12*a*, 12*b*, and the other part of the light source being reflected to the light reflective layer and then emitting outwards to improve the overall brightness.

Figure 6:
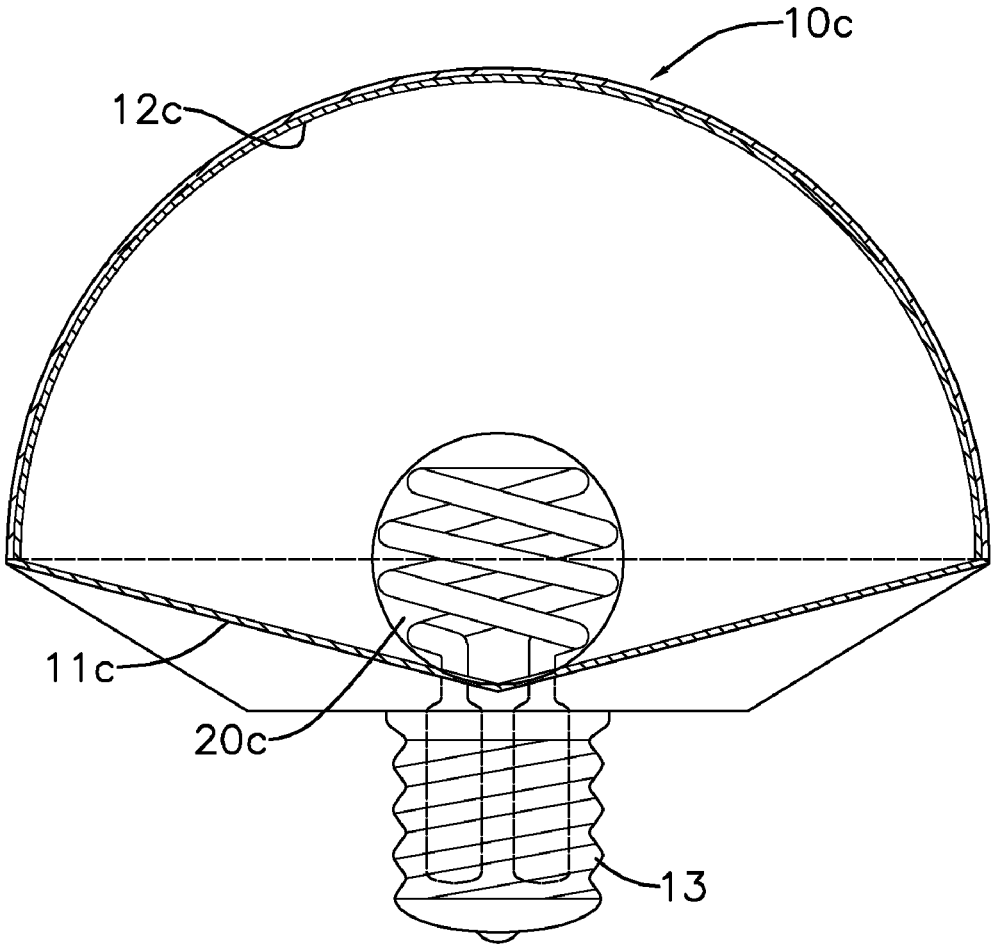
FIG. 6 is a schematic diagram of the embodiment of the present invention that the hemisphere mated with a cone shape.

Referring to FIG. 6, which shown a concrete embodiment of lampshade, of which the transparent envelope 10*c* being designed as a hollow body of a sector in cross section, that is, a hollow envelope being composed of a hemisphere (i.e. a first wall) and a cone (i.e. a second wall), with the inside wall (or outside wall) of the hemisphere wall being coated with optical thin film 12*c*, and the inside wall (or outside wall) of the cone being coated with visible light layer 11*c* or visible light layer 11*c* and light reflective layer, the light-emitting part 20*c* being provided inside the transparent envelope 10*c*, and an electrical connectors 13 being provided outside it for the electrical inter-connection, and the center of the light-emitting part 20*c* being located at the center of the hemisphere of the transparent envelope 10*c* and can be formed by bending the light-emitting tube circumferentially.

Figure 7:
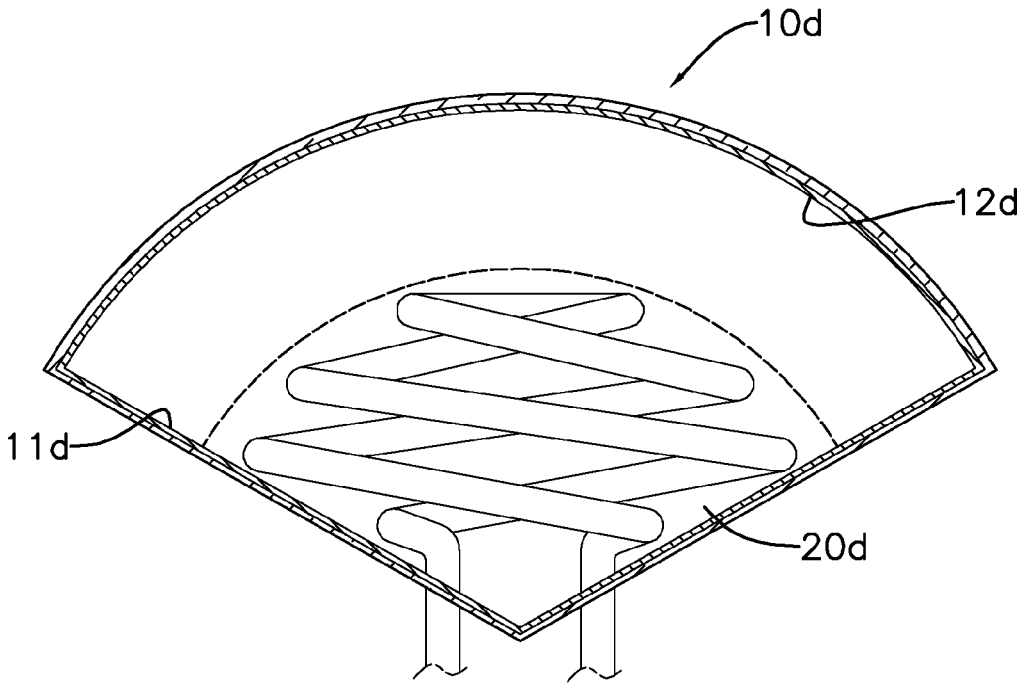
FIG. 7 is a schematic diagram of the embodiment of the present invention that an arc sphere mated with a cone shape.

Referring to the embodiment shown in FIG. 7, in which the transparent envelope 10*d* and the light-emitting part 20*d* disposed therein being both designed as a hollow cone, that is, its cross section is of a sector shape (see the figure), and the center of a circle of the transparent envelope 10*d* and that of the light-emitting part 20*d* being located at the same position, wherein the transparent envelope 10*d* being composed of a spherical envelope (i.e. the first wall) and a conical envelope (the second wall), with the inside wall (or outside wall) of the spherical envelope being coated with an optical thin film 12*d*, and the inside wall (or outside wall) of the cone envelope being coated with a visible light layer 11*d* or visible light layer 11*d* and a light reflective layer, the light-emitting part 20*d* can be formed by bending the light-emitting tube circumferentially.

Figure 8:
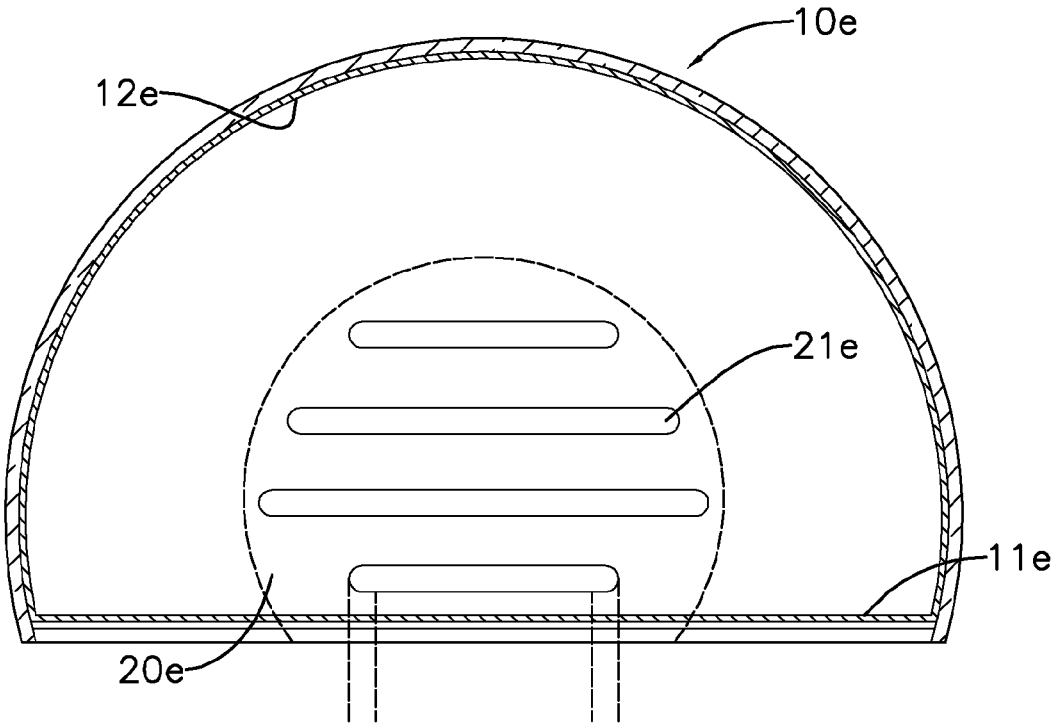
FIG. 8 is a schematic diagram of the embodiment of the hemisphere of the present invention.

Referring to the embodiment shown in FIG. 8, of which the transparent envelope 10*e* and the light-emitting part 20*e* disposed therein both being designed as a shape greater than a hemispheric body, and the central points of them being at the same position, the inside wall (or outside wall) of the arc body (i.e. the first wall) of the transparent envelope 10*e* being coated with an optical thin film 12*e*, and the inside wall (or outside wall) of the flat surface (i.e. the second wall) at the other side being coated with a visible light layer 11*e* or visible light layer 11*e* and a light reflective layer, the light-emitting tube 21*e* of the light-emitting part 20*e* being bent circumferentially and similar to a hemispherical body.

Figure 9:
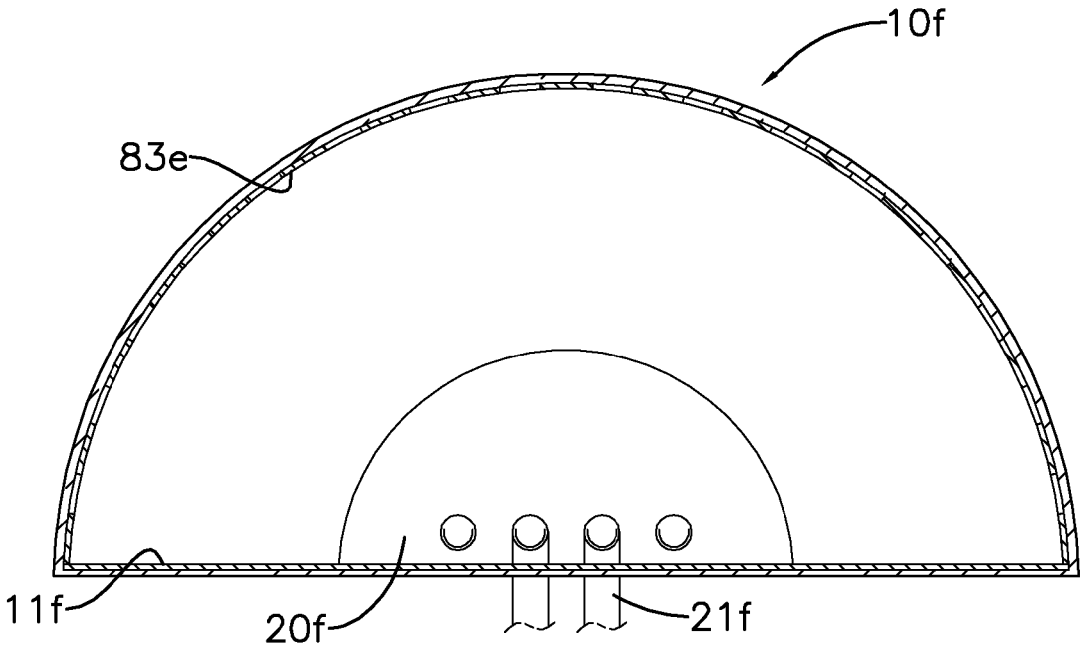
FIG. 9 is a schematic diagram of another embodiment of the hemisphere (or semi-circular tube) of the present invention coated with optical thin film.

Referring to the embodiment shown in FIG. 9, like that shown in FIG. 8, it being provided with a hemisphere body transparent envelope 10*f* and a light-emitting part 20*f* disposed therein, and the central points of them being at the same position, the inside wall (or outside wall) of the arc body (i.e. the first wall) of the transparent envelope 10*f* being partially coated with an optical thin film 83*e*, and the inside wall (or outside wall) of the flat surface (i.e. the second wall) being coated with a visible light layer 11*f* or visible light layer 11*f* and a light reflective layer, the light-emitting part 20*f* being composed of a blue light-emitting tube 21*f* bent circumferentially, and the tube center of the light-emitting tube 21*f* and the flat surface of the transparent envelope 10*f* are of planar design, with the inside of the tube being partially coated with fluorescent/phosphorescent layer.

Figure 10:
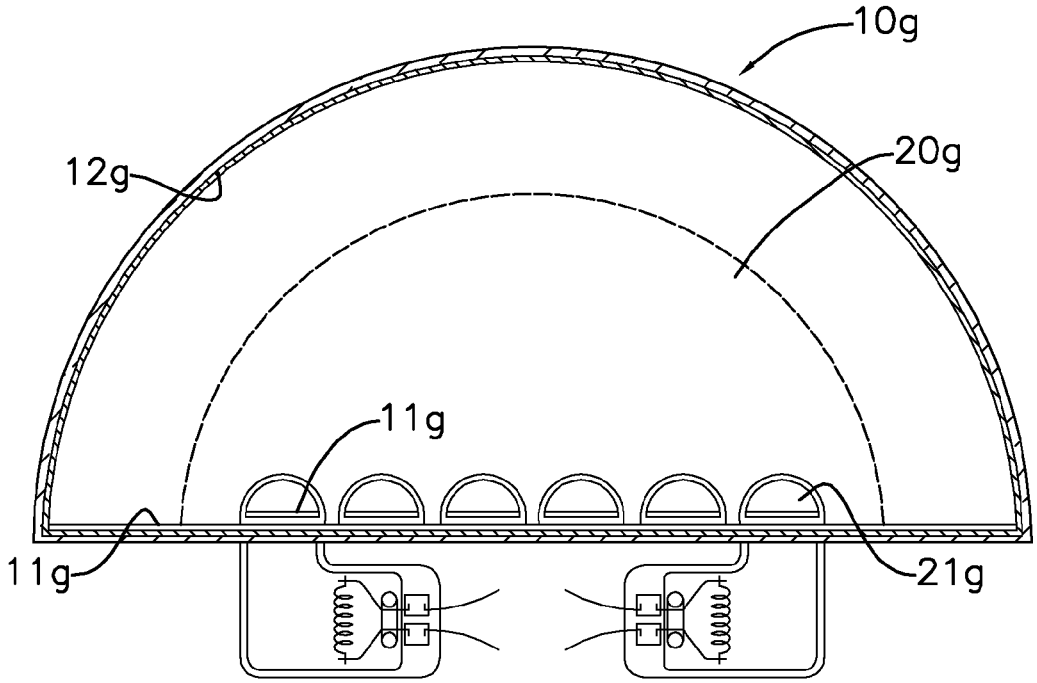
FIG. 10 is a schematic diagram of another embodiment of the hemisphere (or semi-circular tube) of the present invention.

Referring to the embodiment shown in FIG. 10, which is the same in structure as that shown in FIG. 9, it is provided with a transparent envelope 10*g* and a light-emitting part 20*g* disposed therein, and both of them being hemispheres (or hemispherical tubes) having the same center of circle, the inside wall (or outside wall) of the arc body (i.e. the first wall) of the transparent envelope 10*g* being coated with an optical thin film 12*g*, and the flat surface (i.e. the second wall) being coated with a visible light layer 11*g* or visible light layer 11*g* and a light reflective layer, the ultraviolet light-emitting tube 21*g* provided in the light-emitting part 20*g* is located on a flat surface, the cross section of the light-emitting tube 21*g* is of a semicircular shape and its tube center being set parallel with the flat surface, with the inside of the tube being partially coated with fluorescent/phosphorescent layer, and the advantage of fluorescent/phosphorescent coating layer being that the visible light produced by excitation will be available to people almost without passing through other fluorescent/phosphorescent layers, hence, the surface light-emitting efficiency of the fluorescent/phosphorescent layer will not be reduced.

Figure 11:
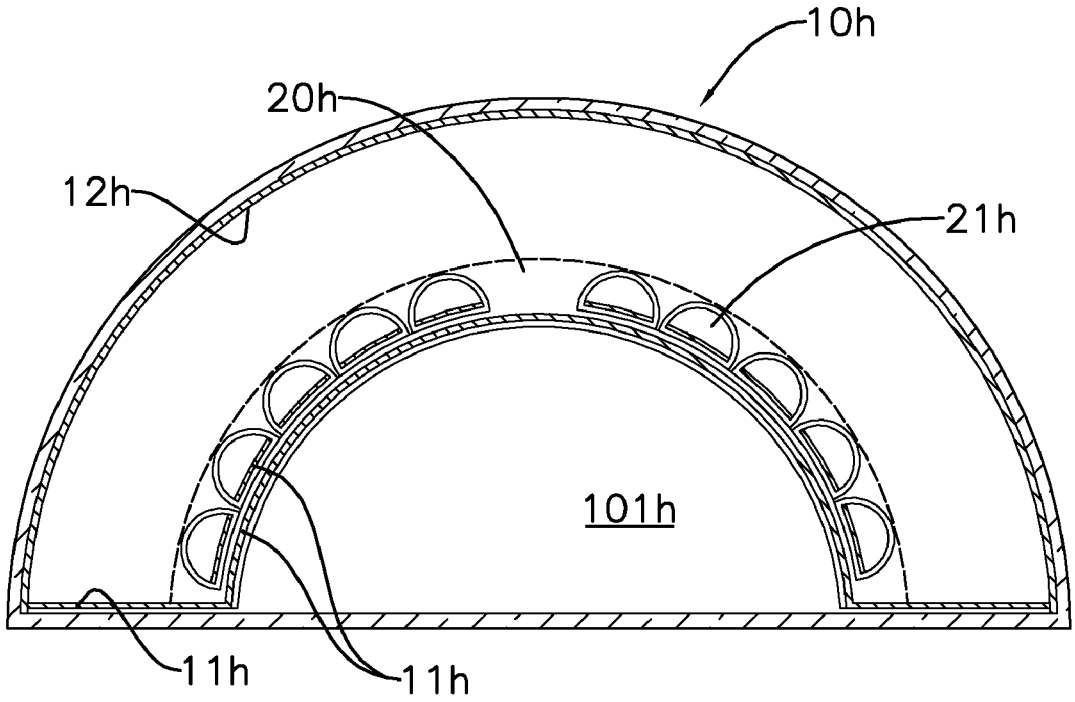
FIG. 11 is a schematic diagram of still another embodiment of the hemisphere (or semi-circular tube) of the present invention.

Referring to the another embodiment shown in FIG. 11, wherein the transparent envelope 10*h* being designed as a hemisphere (or a semi-circular tube, a first wall), with a supporting envelope (a second wall) mating with the shape of the transparent envelope 10*h* being formed inner concavely at its flat surface, and the radius of the supporting envelope being less than the transparent envelope 10*h*, and with a transparent envelope being formed between the two the envelopes of different radius, which is provided with a light-emitting part 20*h* closely leaning against the supporting envelope, with the light-emitting part being formed by bending circumferentially a light-emitting tube 21*h* of semi-circular shape in cross section, and the inside wall (or outside wall) of the hemisphere of the transparent envelope 10*h* being coated with an optical thin film 12*h*, and the flat surface of the transparent envelope 10*h* and the inside wall (or outside wall) of the supporting envelope being coated with a visible light layer 11*h* or visible light layer 11*h* and a light reflective layer, and the visible light of such a curvature is relatively even to the emission of 180 degrees.

Figure 12:
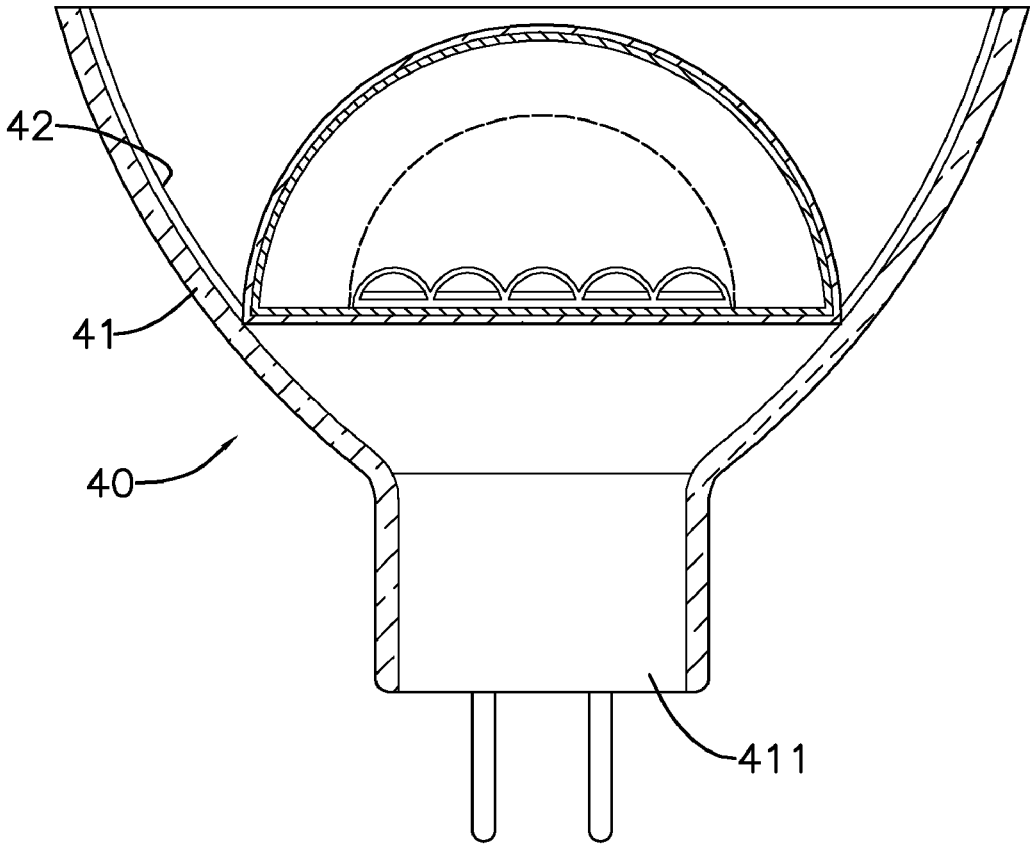
FIG. 12 is a schematic diagram of the embodiment of the present invention used in a lamp.
Figure 13:
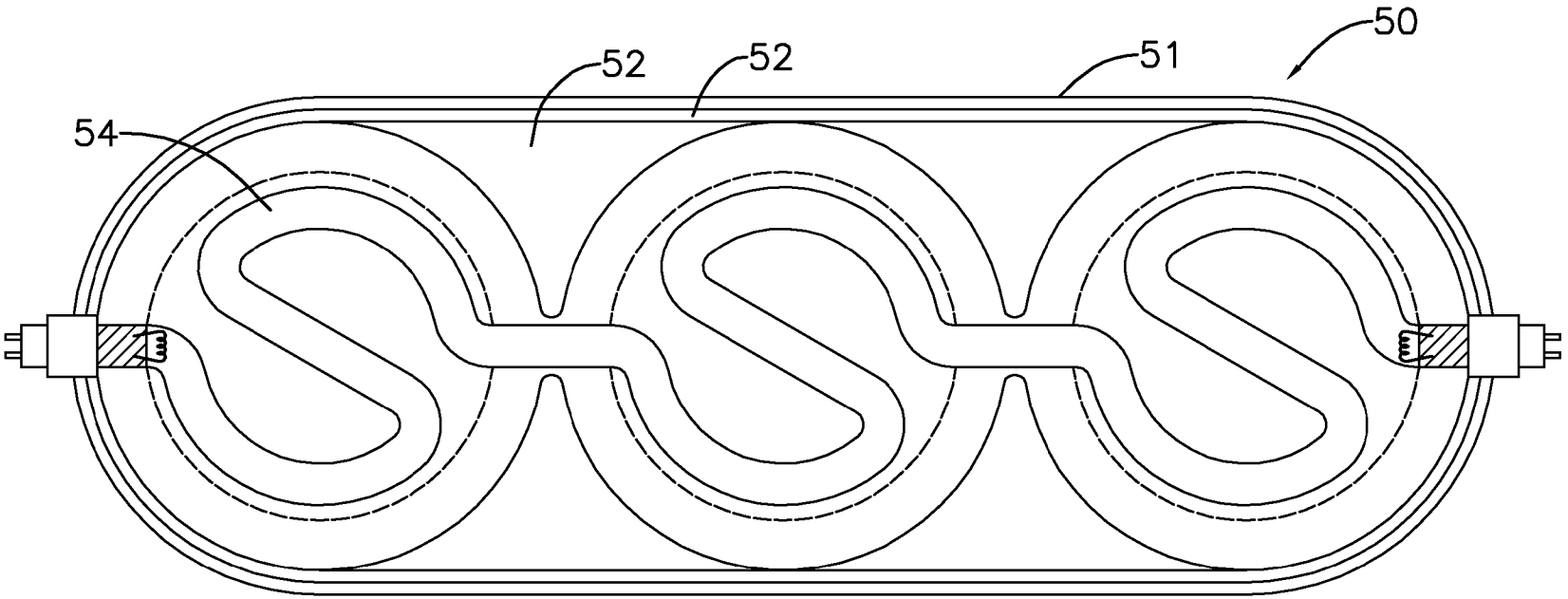
FIG. 13 to FIG. 15 are schematic diagrams of another embodiment of the present invention used in a lamp.
Figure 14:
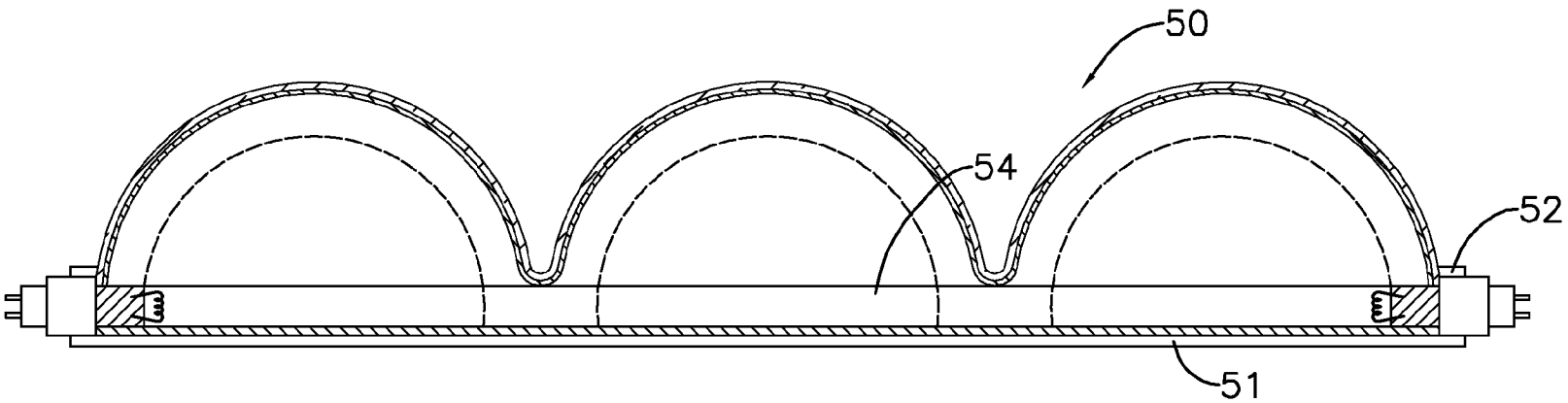

Referring to FIG. 12, which showing a first embodiment of light-emitting module of the present invention used in a lamp, wherein the lamp 40 having a hollow lamp envelope 41, with an accommodating space having an opening being formed at one end of the envelope 41, and an electrical connector 411 being provided at the other end, wherein the inside wall of accommodating space of the hollow envelope 41 being coated with light reflective layer 42 and provided with the light-emitting module of the present invention, in FIG. 10 there is the light-emitting module shown in FIG. 10, of which the light-emitting tube is electrically connected to the electrical connector 411, the light source emitted by the light-emitting module can also be reflected using the light reflective layer 42 to increase the brightness generated by the lamp 40. Referring to FIGS. 13 to 14, which showing a second embodiment of light-emitting module of the present invention used in a lamp, wherein the lamp 50 having a long holder 51, on which several connected light-emitting modules of the present invention being provided, which are fixed to the holder 51 by structure-strengthening pieces 52, as shown in the figure, the light-emitting modules shown in FIGS. 8 to 11 can be used, with the light-emitting modules are series connected to each other, and the light-emitting tubes of the light-emitting modules being connected to each other by a light-emitting tube 54, with the parts at the ends of the light-emitting tube 54 being coated with a fluorescent/phosphorescent layer outside of the tubes.

Figure 15:
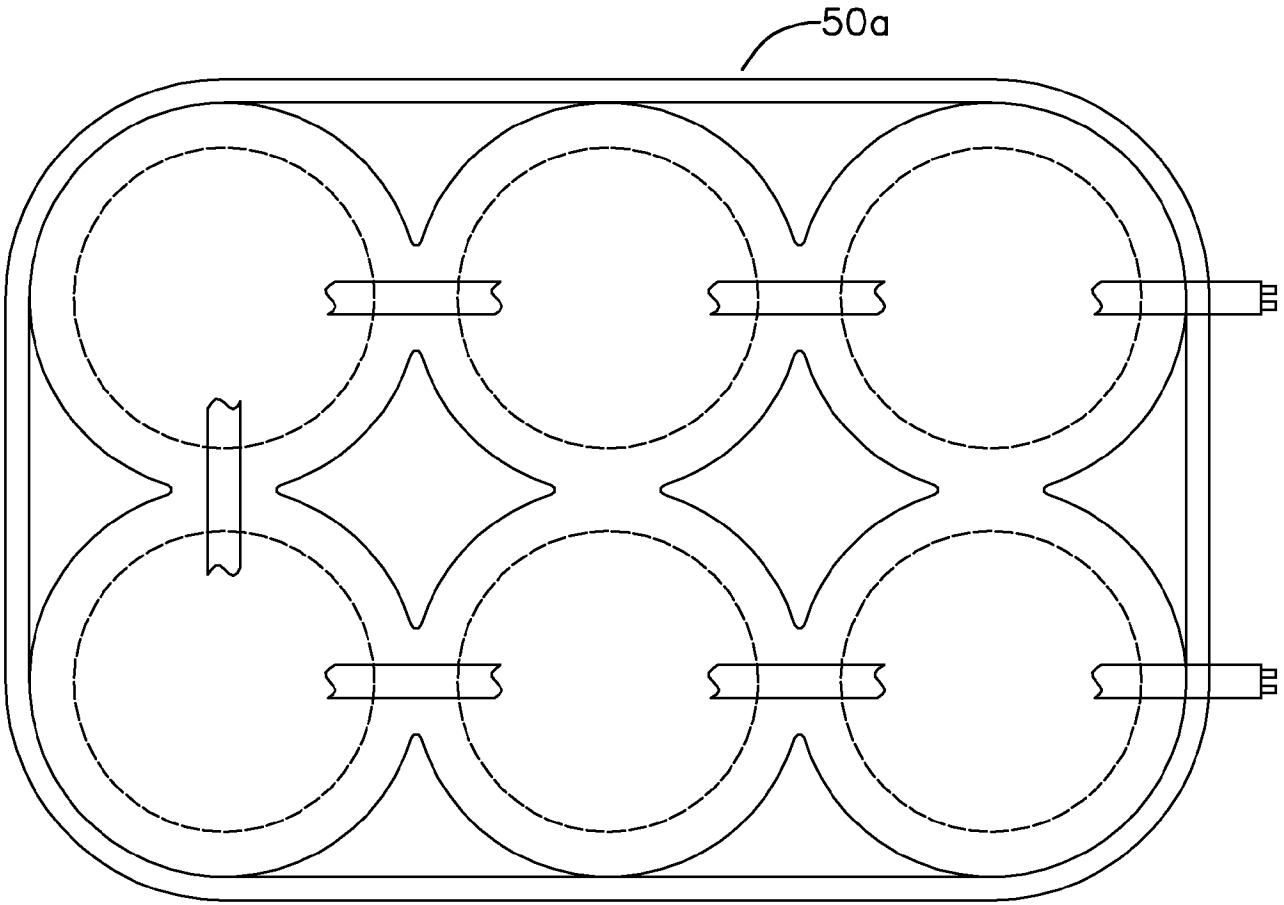
Figure 16:
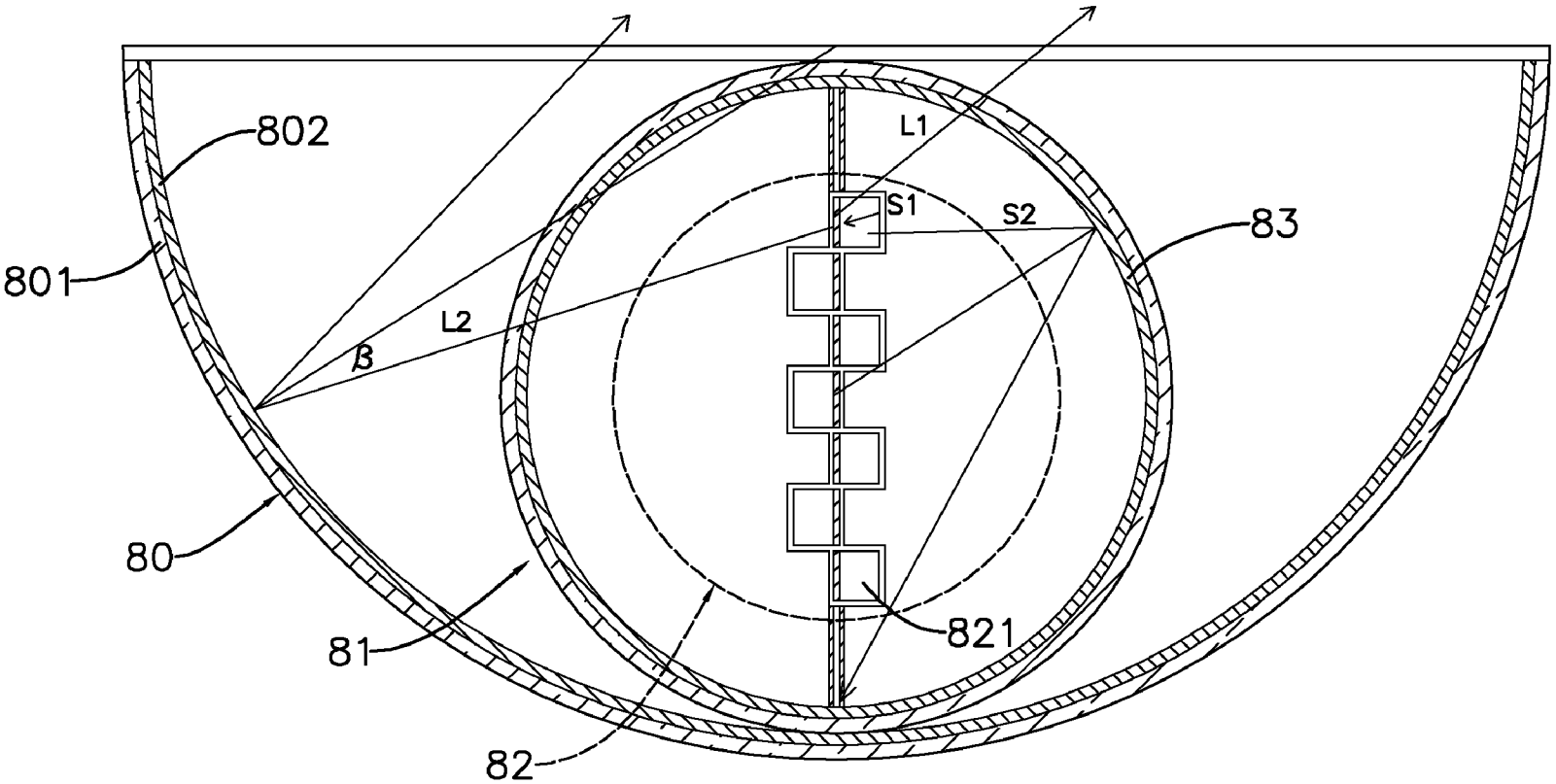
FIG. 16 is a schematic diagram of a first embodiment of the present invention implemented in the lampshade.

Referring to FIG. 15, in which the shown set of lamps 50*a* is composed of the lamps 50 shown in FIGS. 13 and 14 in a designed arrangement. Referring to FIG. 16, which shows is an embodiment of the light-emitting module of the present invention disposed within a lampshade 80, wherein the lampshade 80 having a light reflective lampshade 801 and being provided with a light reflective layer 802 on its inside wall, with the lampshade 801 being semi-circular sphere in its outer shape, namely the depth of its center being not less than (that is, greater than or equal to) its radius, and a transparent light-emitting envelope 81 being provided within the reflective lampshade 801, which can be formed by a circular sphere, partially circular sphere, or by two non-arc surfaces of a semi-circle shape leaning against each other, and the diameter of the transparent light-emitting envelope 81 being less than the radius of the light reflective lampshade 801;

A straight substrate bottom is formed at the center of the sphere of the transparent light-emitting envelope 81, and a light-emitting tube 821 being provided on the substrate bottom and located at the light-emitting area, with the bottom of the substrate and the part of the light-emitting tube 821 near the bottom of the substrate being coated with fluorescent/phosphorescent layer, and the extended line formed thereof being located at any position of the center of sphere of the light reflective lampshade 801 and the lampshade wall, and the preferred position of the extended line is at the center of sphere of the light reflective lampshade to the center;

Therefore, the visible light source of the ultraviolet emitted from the light-emitting tube 821 running through to emit by the transparent light-emitting envelope 81, and the ultraviolet light that can excite fluorescence/phosphorescence is projected to the reflective layer of the optical thin film 83 of the transparent light-emitting envelope 81, and then reflected back to the fluorescence/phosphorescent layer on the bottom of the substrate and the part of the light-emitting tube 821 near the bottom of the substrate, at this moment, its fluorescent/phosphorescent layer being excited to be visible source by the ultraviolet light, and then projected to the outside to improve its overall brightness.

Figure 17:
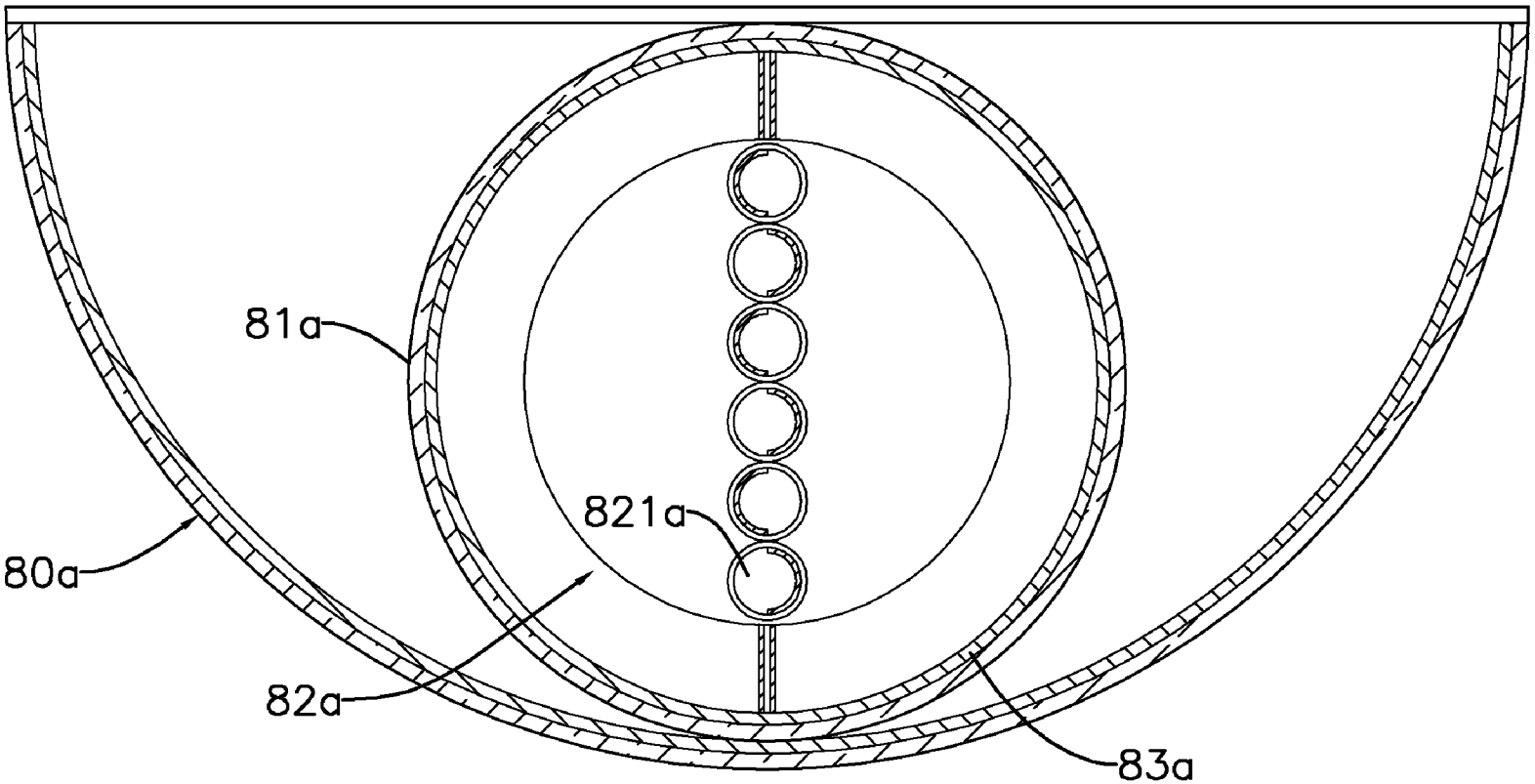
FIG. 17 is a schematic diagram of a second embodiment of the present invention implemented in the lampshade.

Referring to FIG. 17, which is roughly identical to FIG. 16 in structure, wherein its lampshade 80*a* being provided with a transparent light-emitting envelope 81*a* therein, with a light-emitting part 82*a* formed at the light-emitting area by a light-emitting tube 821*a*, and the transparent light-emitting envelope 81*a* is provided with an optical thin film 83*a* on the wall surface, in this embodiment, the cross section of the light-emitting tube 821*a* is of circular shape, some parts of the wall surface within the tube being coated with fluorescent/phosphorescent layer, and the positions of the adjacent tube wall surfaces coated with fluorescent/phosphorescent layer are opposite to each other, as shown in the figure, within the tube from top to bottom, the fluorescent/phosphor layer coated on odd tubes being located at the left-side of the inner tube wall, and the fluorescent/phosphor layer coated on even tubes is located at the right-side of the inner tube wall.

Figure 18:
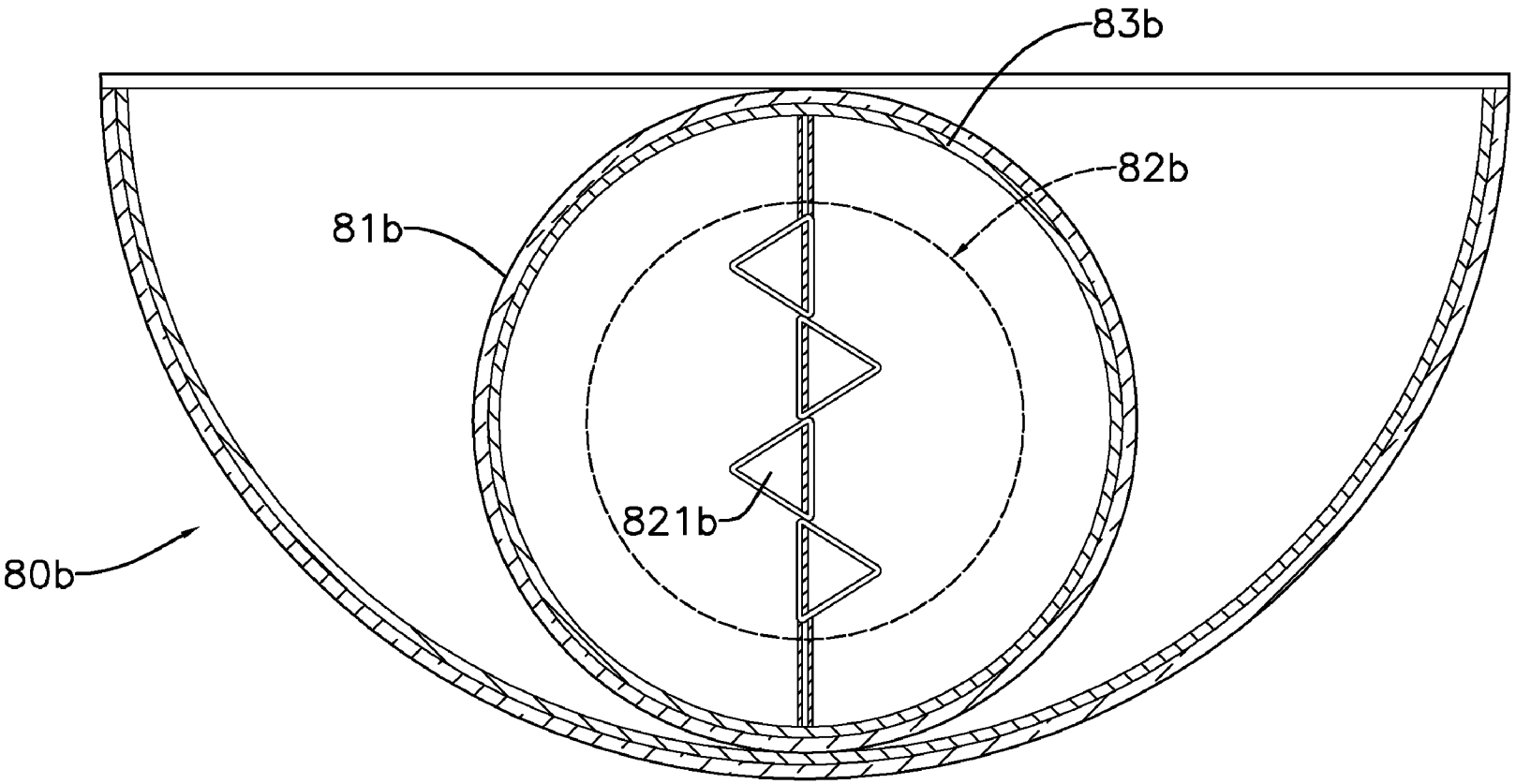
FIG. 18 is a schematic diagram of a third embodiment of the present invention implemented in the lampshade.
Figure 19:
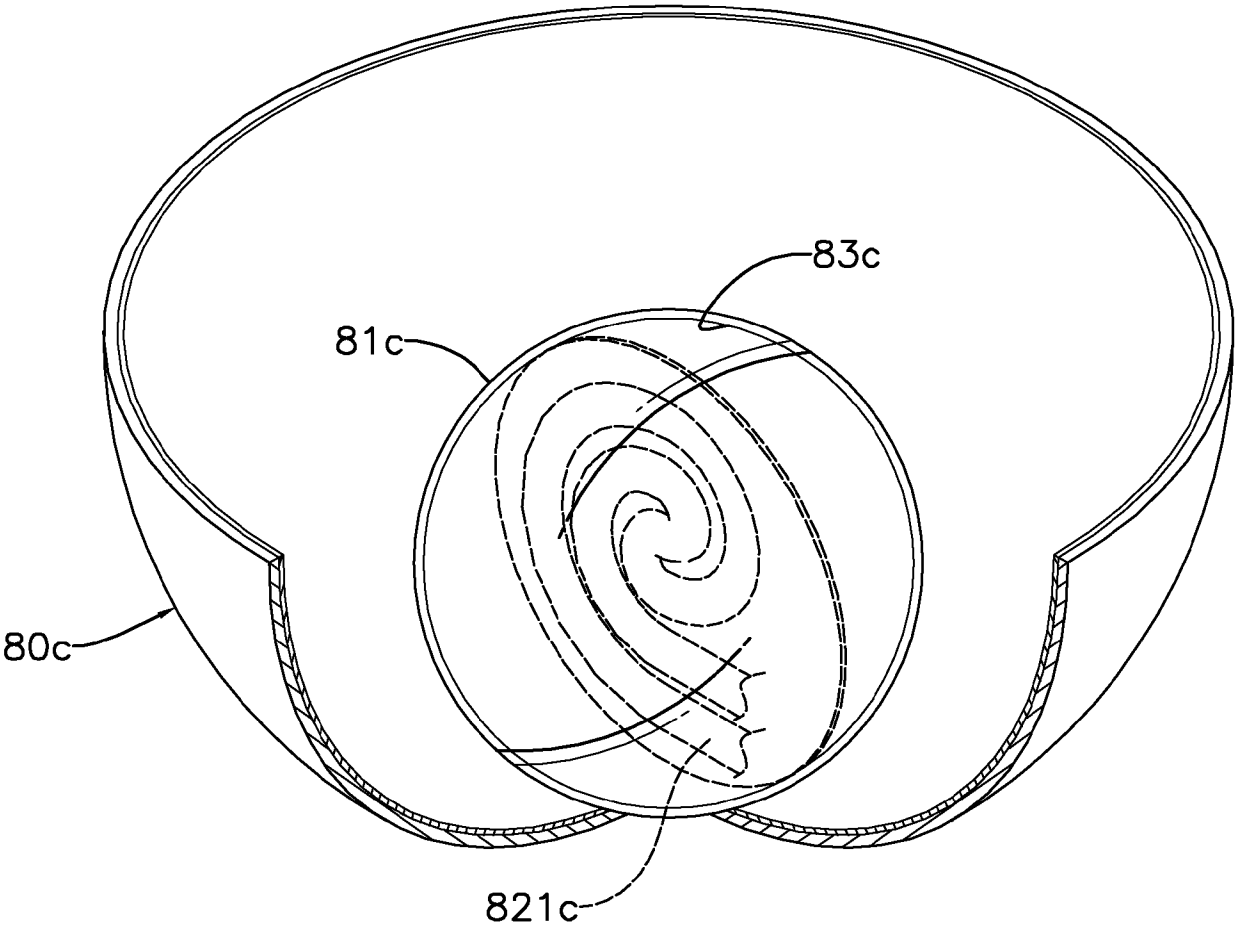
FIG. 19 is a perspective view of the present invention implemented in the lampshade.

Referring to FIG. 18, which is roughly identical to FIG. 17 in structure, wherein its lampshade 80*b* is provided with a transparent light-emitting envelope 81*b* therein, with a light-emitting part 82*b* formed at the light-emitting area by a light-emitting tube 821*b*, and the transparent light-emitting envelope 81*b* being provided with an optical thin film 83*b* on the wall surface, in this embodiment, the cross section of the light-emitting tube 821*b* is of triangular shape, and the inside of the tubes being likewise coated with fluorescent/phosphorescent layer. Referring to FIG. 19, which is a perspective view of an embodiment, of which the structure being likewise provided with a transparent light-emitting envelope 81*c* within the lampshade 80*c*, with a light-emitting part formed at the light-emitting area by a light-emitting tube 821*c* therein, which is of semi-circular shape in cross section, and the transparent light-emitting envelope 81*c* can also be a semi-circle sphere or a sphere formed by two semi-circular spheres, and furthermore, an optical thin film 83*c* being provided on the wall surface of the transparent light-emitting envelope 81*c*.

Figure 20:
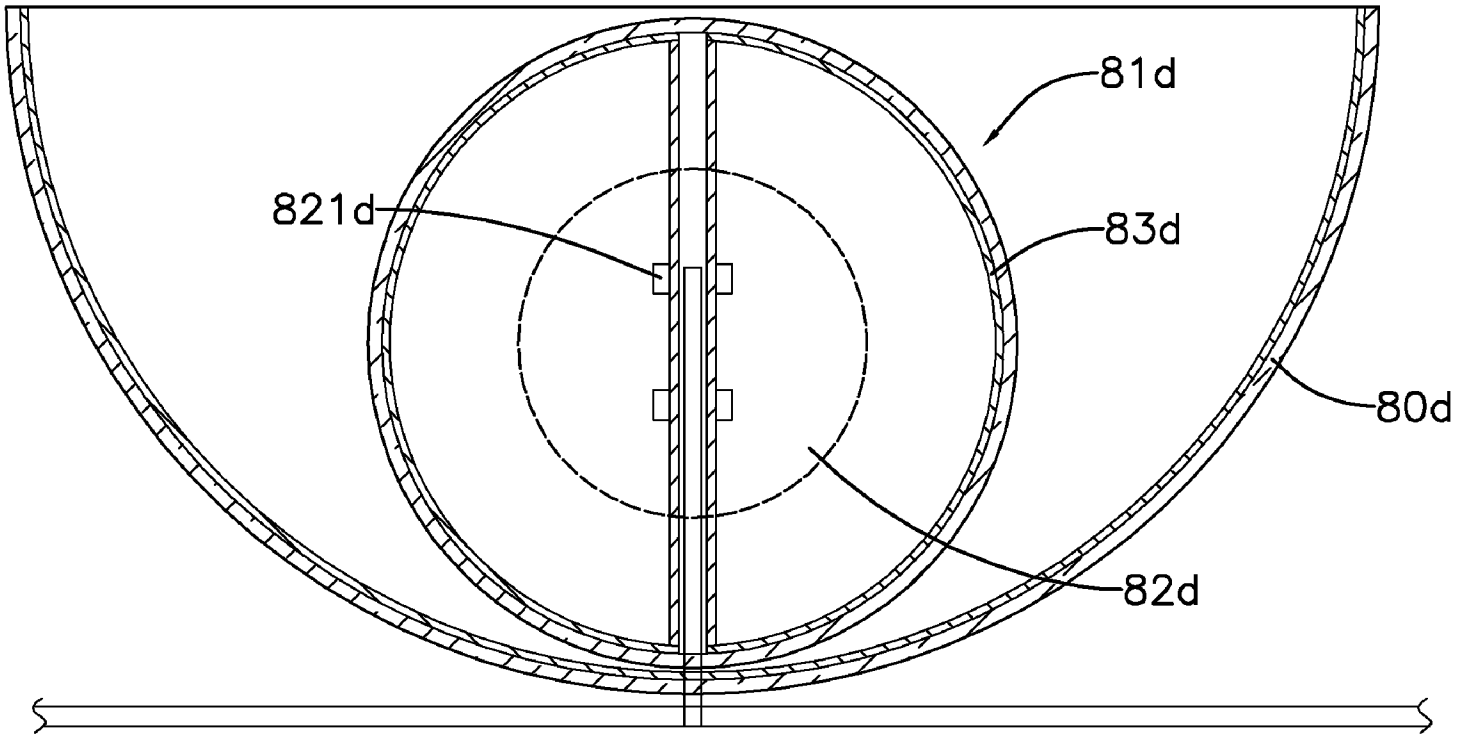
FIG. 20 is an embodiment the light-emitting module of the present invention provided with an ultraviolet light-emitting diode.

Referring to FIG. 20, which shows another embodiment of the light-emitting module of the present invention, which is the same as those shown in FIGS. 16 to 19, with the exception that at least one UV light-emitting diode 821*d*, instead of a light-emitting tube, being provided with the light-emitting area of the light-emitting part 82*d* provided within the transparent light-emitting envelope 81*d*, as shown in the figure, four UV light-emitting diodes 821*d* facing different directions being provided, which are located at the non-center of sphere of the transparent light-emitting envelope 81*d*, with the transparent light-emitting envelope 81*d* being provided with an optical thin film 83*d* on the wall surface, and a light reflective lampshade 80*d* being further provided to provide the installation settings of the transparent light-emitting envelope 81*d*.

Figure 21:
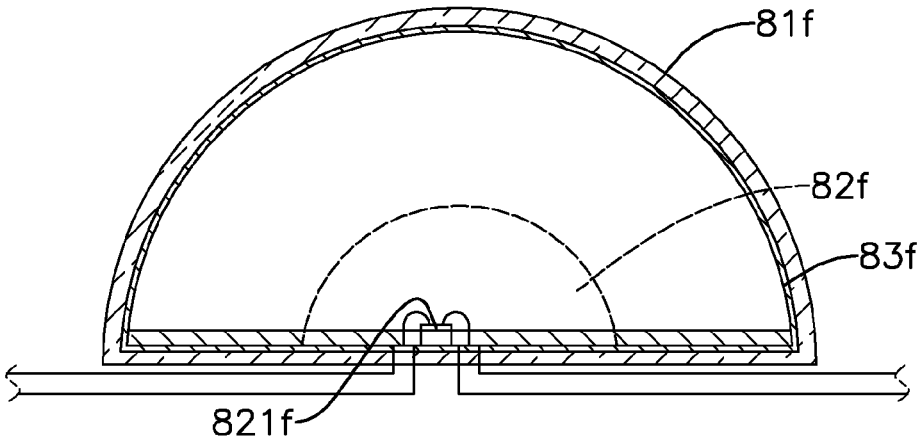
FIG. 21 is another embodiment of FIG. 20.

Referring to FIG. 21, which is the same as FIG. 20 and at the light-emitting area of the light-emitting part 82*f* of the transparent light-emitting envelope 81*f*, there is provided with at least one ultraviolet light-emitting diode 821*f*, and the transparent light-emitting envelope 81*f* is of a semi-circular shape and the light-emitting part 82*f* is correspondingly of a semi-circular sphere shape and having a flat bottom, the transparent light-emitting envelope 81*f* being provided with an optical thin film 83*f* on the wall surface, with the ultraviolet light-emitting diode 821*f* being located at the non-center of sphere of the flat bottom, since the path from the center of the circle and reflected back to the spherical surface will pass through the center of the circle again, the fluorescence/phosphorescence will not be excited.

Figure 22:
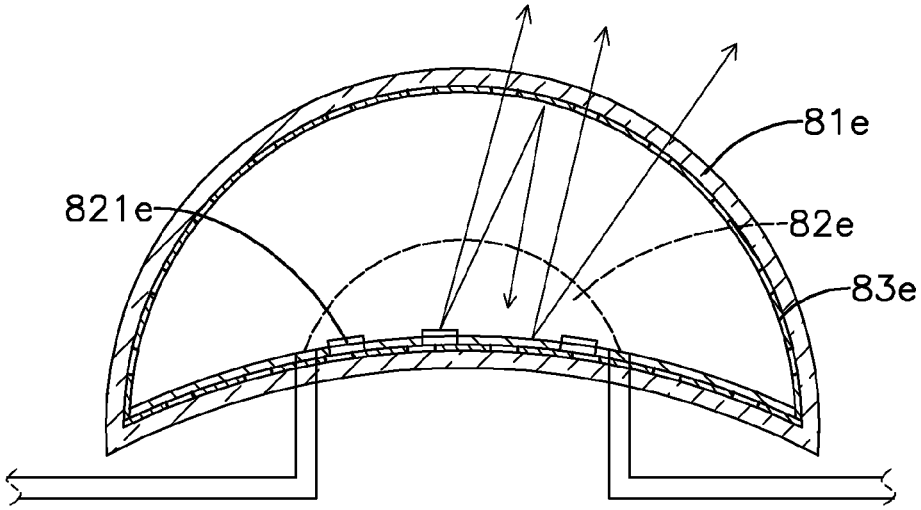
FIG. 22 is an embodiment a blue light-emitting diode structure coated with optical thin film.

Referring to the embodiment shown in FIG. 22, its transparent light-emitting envelope 81*e* being slightly identical to that shown in FIG. 21, and the transparent light-emitting envelope 81*e* being coated with an optical thin film 83*e* on part of the wall surface, or part of the wall is hollow and uncoated with the optical thin film 83*e*, another difference being that besides its profile is of a semi-circular spherical shape as the light-emitting part 82*e*, its bottom surface being also of relatively arc shape, i.e. not a flat surface, with its bottom being likewise provided with at least one blue light-emitting diode 821*f*, and each of the blue light-emitting diodes 821*f* being located at the same non-center of sphere, three blue light-emitting diodes 821*f* being shown in the figure, and the fluorescence/phosphorescence layer being a coating emitting yellow or red or green light, and as for the blue light-emitting diodes package, fillers of the epoxy resin can be filled in the transparent light-emitting envelope.

Figure 24:
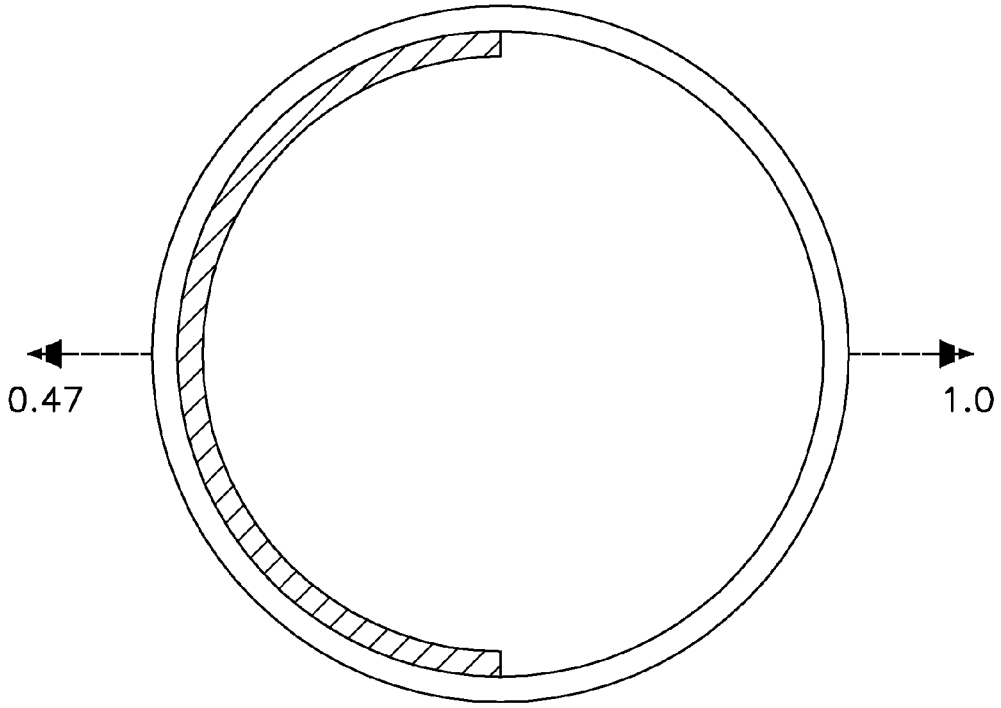
FIG.24 PRIOR ART
FIG. 24 is a schematic diagram of thickness and brightness of the fluorescent layer of single-sided coating of the prior art.

The fluorescent layer of the present invention can be thickened as possible without worrying about blocking visible light to pass through, so ultraviolet light is fully absorbed while the brightness is higher than the inner layer of the tube of prior art (see FIG. 24). In addition, the fluorescent layer can be formed on the flat surface while providing a larger reflective surface at its vertical, the fluorescent light at the surface layer and the inner layer can be taken out for use at the same time without degradation, this is actually an energy-saving innovation in lighting.

What stated above is only preferred embodiments of the present invention, which is illustrative only and not restrictive. Many changes, modifications, or the equivalents may be made by those skilled in the art without departing from the spirits and scope of the present invention as defined by the claims, but will fall within the scope of protection of the present invention.

What is claimed is:

1. A brightness improving structure of a light-emitting module with an optical thin-film surface layer, characterized in that said structure comprising: a transparent envelop shaped as a hollow sphere, a partial hollow sphere or a hollow body similar to a sphere and having a first wall and a second wall opposite to the first wall on the envelop, below the envelop or between the envelop and its internal center, said first wall having a first inside wall surface and a first outside wall surface, said second wall adjoining said first wall and having a second inside wall surface and a second outside wall surface; an optical thin-film which being a non-omni angular multiple layers film and having a long wave pass light filter function, and being coated on the first inside wall surface or the first outside wall surface of the transparent envelop over 30% of its area, said optical thin-film reflecting light rays at least comprising part or all ultraviolet or blue light exciting a fluorescent/phosphorescent layer and at least comprising visible light source which being in the long-wave band of visible wave length, and running through to emit; a light-emitting part shaped as a sphere, a spherical area or a partial sphere arranged in the transparent envelop so the transparent envelop and the light-emitting part being space-arranged for emitting ultraviolet or blue light by at least one ultraviolet or blue light-emitting diode, or a light-emitting tube or light-emitting electrodes provided in the light-emitting part; and a visible light layer formed of the fluorescent/phosphorescent layer, said visible light layer being coated on the second inside wall surface or the second outside wall surface the second wall surface of the transparent envelop for exciting the ultraviolet or blue light into visible light source, and the visible light layer being closer to the light-emitting part than to the optical thin-film; wherein the distance c between an any point A of the reflecting layer of arc of said optical thin-film and a center of sphere B of the light-emitting part should meet the following relationship: $c \geqq \csc\alpha \times r$, wherein r being the radius of the light-emitting part, $\alpha$ being the incidence angle at the point A of the reflecting layer of said optical thin-film and a being 0 to 60°, a connection line of A and B being the normal of the reflection angle at point A, and b being the distance projecting to tangential point of the periphery circumference of the light-emitting part from the point A of the reflecting layer.

2. The brightness improving structure of the light-emitting module with the optical thin-film surface layer according to claim 1, characterized in that: said transparent envelop being a partial sphere, which having an arc spherical surface and a bottom thereof interconnecting with each other, said first wall is arranged on the arc spherical surface of the partial sphere and said second wall is arranged on the bottom of the envelop, and at least a part of the light-emitting part being a partial sphere whose arc spherical surface is opposite to the arc spherical surface of the transparent envelop.

3. The brightness improving structure of the light-emitting module with the optical thin-film surface layer according to claim 1, characterized in that: said structure further providing with a reflective lampshade shaped as a hollow arc hemisphere with a radius, at least a transparent envelop being provided therein, the extension line of the second wall of the transparent envelop bottom of the hemisphere-shaped transparent envelop being positioned at the center of sphere of the reflective lampshade and an any point on the lampshade wall, and the depth of the center of the arc sphere being greater or equal to the height of the visible light layer coated area of the transparent envelop in the arc.

4. The brightness improving structure of the light-emitting module with the optical thin-film surface layer according to claim 1, characterized in that: said transparent envelop being a partial sphere, which having an arc spherical surface and a bottom thereof interconnecting with each other, said first wall is arranged on the arc spherical surface of the partial sphere and said second wall is arranged inside the envelop, said first wall is arranged on the arc spherical surface of the partial sphere and said second wall is arranged inside the envelop, and at least a part of the light-emitting part being a partial sphere whose arc spherical surface is opposite to the arc spherical surface of the transparent envelop.

5. The brightness improving structure of the light-emitting module with the optical thin-film surface layer according to claim 1, characterized in that: said light-emitting part being an ultraviolet or blue light luminescent tube arranged in the light-emitting part in form of rotation-wound, the inside wall surface of said luminescent tube being partially coated with a fluorescent/phosphorescent layer.

6. The brightness improving structure of the light-emitting module with the optical thin-film surface layer according to claim 1, characterized in that: the visible light layer is not at the center of the light-emitting part.

7. The brightness improving structure of the light-emitting module with the optical thin-film surface layer according to claim 1, characterized in that: the optical thin-film is coated hollowly.

8. The brightness improving structure of the light-emitting module with the optical thin-film surface layer according to claim 1, characterized in that: the visible light layer forms a straight wall surface.

9. The brightness improving structure of the light-emitting module with the optical thin-film surface layer according to claim 2, characterized in that: said structure further providing with a reflective lampshade shaped as a hollow arc, at least a transparent envelop being provided therein, the extension line of the second wall of the transparent envelop being positioned at the center of sphere of the reflective lampshade and an any point on the lampshade wall, and the depth of the center of the arc sphere being greater or equal to the height of the visible light layer coated area of the transparent envelop in the arc.

10. The brightness improving structure of the light-emitting module with the optical thin-film surface layer according to claim 4, characterized in that: said structure further providing with a reflective lampshade shaped as a hollow arc, at least a transparent envelop being provided therein, the extension line of the second wall of the transparent envelop being positioned at the center of sphere of the reflective lampshade and an any point on the lampshade wall, and the depth of the center of the arc sphere being greater or equal to the height of the visible light layer coated area of the transparent envelop in the arc.

11. The brightness improving structure of the light-emitting module with the optical thin-film surface layer according to claim 5, characterized in that: said structure further providing with a reflective lampshade shaped as a hollow arc, at least a transparent envelop being provided therein, the extension line of the second wall of the transparent envelop being positioned at the center of sphere of the reflective lampshade and an any point on the lampshade wall, and the depth of the center of the arc sphere being greater or equal to the height of the visible light layer coated area of the transparent envelop in the arc.

12. The brightness improving structure of the light-emitting module with the optical thin-film surface layer according to claim 6, characterized in that: said structure further providing with a reflective lampshade shaped as a hollow arc, at least a transparent envelop being provided therein, the extension line of the second wall of the transparent envelop being positioned at the center of sphere of the reflective lampshade and an any point on the lampshade wall, and the depth of the center of the arc sphere being greater or equal to the height of the visible light layer coated area of the transparent envelop in the arc.

13. The brightness improving structure of the light-emitting module with the optical thin-film surface layer according to claim 7, characterized in that: said structure further providing with a reflective lampshade shaped as a hollow arc, at least a transparent envelop being provided therein, the extension line of the second wall of the transparent envelop being positioned at the center of sphere of the reflective lampshade and an any point on the lampshade wall, and the depth of the center of the arc sphere being greater or equal to the height of the visible light layer coated area of the transparent envelop in the arc.

14. The brightness improving structure of the light-emitting module with the optical thin-film surface layer according to claim 8, characterized in that: said structure further providing with a reflective lampshade shaped as a hollow arc, at least a transparent envelop being provided therein, the extension line of the second wall of the transparent envelop being positioned at the center of sphere of the reflective lampshade and an any point on the lampshade wall, and the depth of the center of the arc sphere being greater or equal to the height of the visible light layer coated area of the transparent envelop in the arc.

15. The brightness improving structure of the light-emitting module with the optical thin-film surface layer according to claim 3, characterized in that: the reflective lampshade uses a full-dielectric invisible light reflection film, and the transparent envelop in the spherical area is concentrically arranged at intervals with the reflective lampshade.

16. The brightness improving structure of the light-emitting module with the optical thin-film surface layer according to claim 9, characterized in that: the reflective lampshade uses a full-dielectric invisible light reflection film, and the transparent envelop in the spherical area is concentrically arranged at intervals with the reflective lampshade.

17. The brightness improving structure of the light-emitting module with the optical thin-film surface layer according to claim 10, characterized in that: the reflective lampshade uses a full-dielectric invisible light reflection film, and the transparent envelop in the spherical area is concentrically arranged at intervals with the reflective lampshade.

18. The brightness improving structure of the light-emitting module with the optical thin-film surface layer according to claim 11, characterized in that: the reflective lampshade uses a full-dielectric invisible light reflection film, and the transparent envelop in the spherical area is concentrically arranged at intervals with the reflective lampshade.

19. The brightness improving structure of the light-emitting module with the optical thin-film surface layer according to claim 12, characterized in that: the reflective lampshade uses a full-dielectric invisible light reflection film, and the transparent envelop in the spherical area is concentrically arranged at intervals with the reflective lampshade.

20. The brightness improving structure of the light-emitting module with the optical thin-film surface layer according to claim 13, characterized in that: the reflective lampshade uses a full-dielectric invisible light reflection film, and the transparent envelop in the spherical area is concentrically arranged at intervals with the reflective lampshade.

21. The brightness improving structure of the light-emitting module with the optical thin-film surface layer according to claim 14, characterized in that: the reflective lampshade uses a full-dielectric invisible light reflection film, and the transparent envelop in the spherical area is concentrically arranged at intervals with the reflective lampshade.

22. The brightness improving structure of the light-emitting module with the optical thin-film surface layer according to claim 1, characterized in that: the visible light layer or the visible light layer and a reflective layer is coated on the inside wall surface or the outside wall surface of the second wall.

* * * * *